US008744620B2

(12) United States Patent
Shavelsky et al.

(10) Patent No.: US 8,744,620 B2
(45) **Date of Patent: *Jun. 3, 2014**

(54) INTERACTIVE MEDICATION DISPENSING SYSTEM WITH LOCKING COMPARTMENTS

(75) Inventors: Eran Shavelsky, Newton, MA (US); Woodie C. Flowers, Weston, MA (US); Justin F. Aiello, Kennebunk, ME (US)

(73) Assignee: MedMinder Systems, Inc., Newton, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/488,165

(22) Filed: Jun. 4, 2012

(65) Prior Publication Data

US 2013/0030566 A1 Jan. 31, 2013

Related U.S. Application Data

(63) Continuation-in-part of application No. 12/606,643, filed on Oct. 27, 2009, now Pat. No. 8,193,918.

(60) Provisional application No. 61/197,859, filed on Oct. 31, 2008, provisional application No. 61/523,041, filed on Aug. 12, 2011.

(51) Int. Cl.
*G06F 17/00* (2006.01)
*A47F 1/04* (2006.01)

(52) U.S. Cl.
USPC ..... 700/237; 700/242; 700/244

(58) Field of Classification Search
USPC ..... 700/240, 237, 242, 232, 236, 244
See application file for complete search history.

(56) References Cited

U.S. PATENT DOCUMENTS

| | | | | |
|---|---|---|---|---|
| 2,964,370 | A * | 12/1960 | Butler | 312/222 |
| 4,693,371 | A | 9/1987 | Malpass | |
| 5,159,581 | A * | 10/1992 | Agans | 368/10 |
| 5,710,551 | A | 1/1998 | Ridgeway | |
| 5,954,225 | A | 9/1999 | Powe | |

(Continued)

FOREIGN PATENT DOCUMENTS

CA 2261424 A1 8/2000

OTHER PUBLICATIONS

O'Connor, "Improving Medication Adherence: Challenges for Physicians, Payers, and Policy Makers", Sep. 25, 2006, pp. 1802-1804, vol. 166, No. 17, Published in: US.

(Continued)

*Primary Examiner* — Michael K Collins
(74) *Attorney, Agent, or Firm* — Loginov & Sicard; William A. Loginov

(57) ABSTRACT

This invention provides a system and method for dispensing medication and a dispensing apparatus that comprises a plurality of compartments in an array within a housing, the compartments having respective lids, each of the lids being movable from a closed position to an open position, the respective lids each having a latch that secures the lid in a locked configuration in the closed position. The apparatus has an actuator mechanism that selectively unlocks the latch of each of the lids at a predetermined time so as to place the unlocked lid in an unlocked configuration that enables the lid to be moved to the open position. The compartments of the medication dispenser each receive a removable cup therein that is accessible when a respective of the lids associated therewith is in the open position. Other features, such as communication and messaging and/or audible/visual displays can also be provided.

24 Claims, 27 Drawing Sheets

(56) References Cited

U.S. PATENT DOCUMENTS

| | | | | |
|---|---|---|---|---|
| 6,169,707 | B1 * | 1/2001 | Newland | 368/10 |
| 6,457,611 | B1 | 10/2002 | Koehler | |
| 7,142,944 | B2 * | 11/2006 | Holmes et al. | 700/237 |
| 7,344,047 | B2 * | 3/2008 | Gilmore | 221/2 |
| 7,369,919 | B2 | 5/2008 | Vonk et al. | |
| 7,909,418 | B2 * | 3/2011 | McFarland | 312/215 |
| 8,090,473 | B2 * | 1/2012 | Higham | 700/242 |
| 8,193,918 | B1 * | 6/2012 | Shavelsky et al. | 340/309.16 |
| 8,197,017 | B2 * | 6/2012 | Rahilly | 312/222 |
| 8,234,008 | B2 * | 7/2012 | Weber | 700/242 |
| 8,253,561 | B2 * | 8/2012 | Bowers | 340/540 |
| 8,517,215 | B2 * | 8/2013 | Shafir | 221/152 |
| 2002/0149472 | A1 * | 10/2002 | Roe | 340/309.15 |
| 2008/0164272 | A1 | 7/2008 | Dallman | |
| 2010/0049361 | A1 | 2/2010 | Bertrand et al. | |
| 2011/0101018 | A1 * | 5/2011 | Shafir | 221/1 |
| 2012/0004772 | A1 * | 1/2012 | Rahilly et al. | 700/237 |
| 2013/0002795 | A1 * | 1/2013 | Shavelsky et al. | 348/14.01 |
| 2013/0024022 | A1 * | 1/2013 | Bowers | 700/236 |
| 2013/0030566 | A1 * | 1/2013 | Shavelsky et al. | 700/244 |

OTHER PUBLICATIONS

Harrisinteractive, "Prescription Drug Compliance a Significant Challenge for Many Patients, According to New National Survey", Mar. 29, 2005, Publisher: HarrisInteractive, Published in: US.

Col, et al., "The Role of Medication Noncompliance and Adverse Drug Reactions in Hospitalizations of the Elderly", Apr. 1990, pp. 841-845, vol. 150, No. 4, Publisher: Archives of Internal Medicine, Published in: US.

* cited by examiner

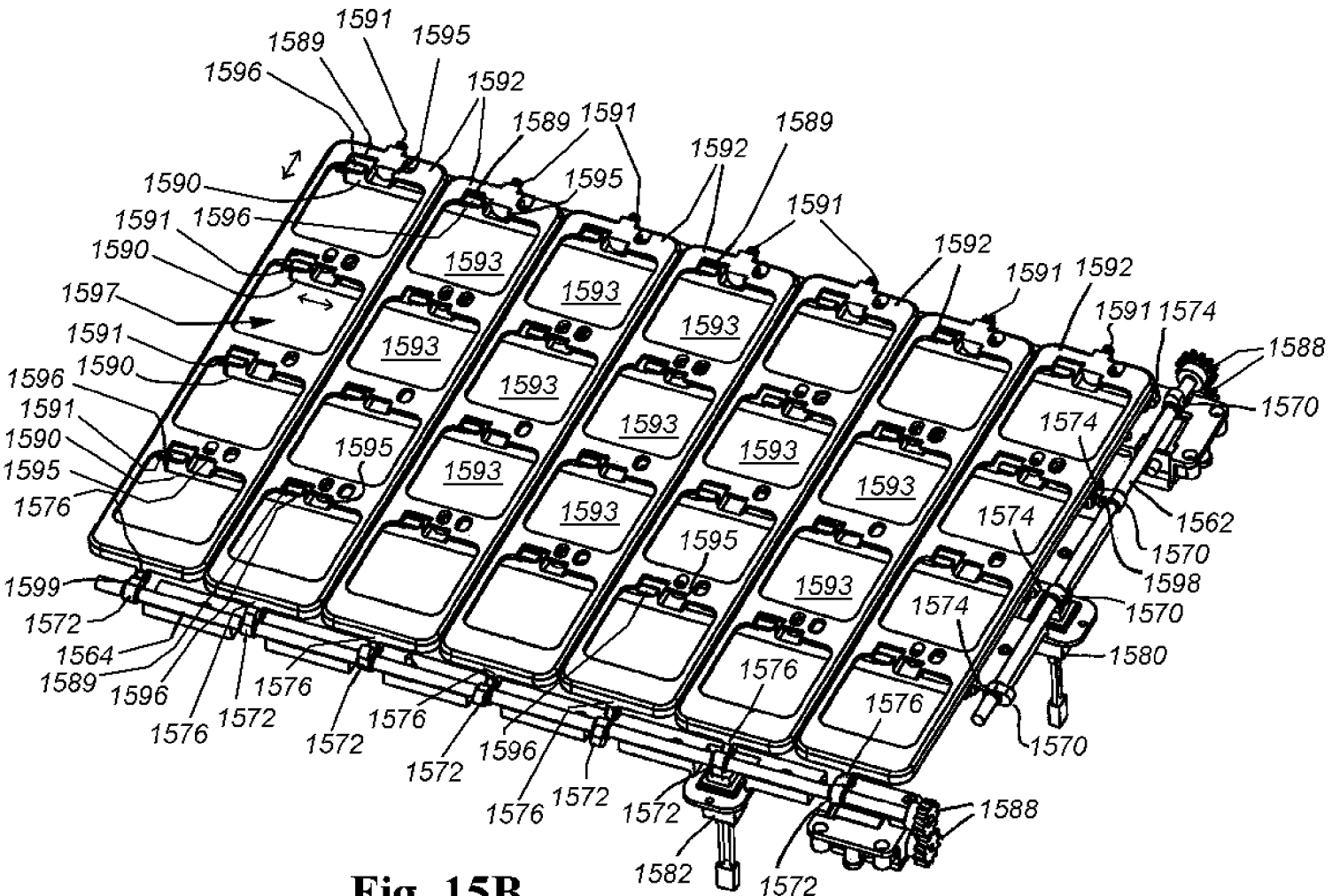
1588
1570
1562
1570
1598
1570
1580
1570
1588
1574
1591
1592
1591
1592
1591
1589
1592
1591
1595
1589
1592
1595
1591
1589
1596
1590
1591
1590
1597
1591
1590
1596
1591
1590
1595
1576
1599
1572
1564
1589
1596
1576
1572
1576
1572
1576
1572
1576
1572
1576
1596
1572
1582
1572
1576
1572
1576
1572
1576
1572
1576

INTERACTIVE MEDICATION DISPENSING SYSTEM WITH LOCKING COMPARTMENTS

RELATED APPLICATIONS

This application claims the benefit of U.S. Provisional Application Ser. No. 61/523,041, entitled INTERACTIVE MEDICATION DISPENSING SYSTEM WITH LOCKING COMPARTMENTS, by Eran Shavelsky, Justin Aiello, Woodie C. Flowers, filed Aug. 12, 2011, and is a continuation-in-part of co-pending U.S. patent application Ser. No. 12/606,643, entitled INTERACTIVE MEDICATION DISPENSING SYSTEM, by Eran Shavelsky, Woodie C. Flowers, Justin Aiello, filed Oct. 27, 2009, which claims the benefit of U.S. Provisional Application Ser. No. 61/197,859, entitled INTERACTIVE MEDICATION DISPENSING SYSTEM, by Eran Shavelsky, Woodie C. Flowers, Justin Aiello, filed Oct. 31, 2008, the teachings of each of which applications is expressly incorporated herein by reference.

FIELD OF THE INVENTION

This invention relates to systems and methods for ensuring compliance by a patient in taking scheduled medications and containers for accomplishing this objective.

BACKGROUND OF THE INVENTION

Poor adherence to medication schedules is a recognized medical problem, costing an estimated $100 billion a year (Improving Medication Adherence, *Archives of Internal Medicine* 2006, 166:1802-1804). Failing to comply with pharmacological therapies leads to over approximately 125,000 deaths in the US each year, twice the number of people killed in automobile accidents (http://www.harrisinteractive-.com/news/allnewsbydate.asp?NewsID=904). Almost 30% of all hospital admissions for people over the age of 65 are directly attributable to medication non-compliance (*Archives of Internal Medicine* 1990; 150: 841-845). Nearly $48 billion in annual costs result from unnecessary medication-induced hospitalization (*Archives of Internal Medicine*—October 1995). Approximately 40% of people entering nursing homes do so because they are unable to self-medicate in their own homes (Feasibility Study, *Biomedical Business International*, January 1988). About one-half of the 1.8 billion prescriptions dispensed annually are not taken correctly, contributing to prolonged or additional illnesses (*Medications and the Elderly*, Ch. 4 pp 67-68, 75).

Care management and Health Plans currently rely on labor-intensive and costly intervention programs to improve medication compliance. Directly Observed Therapy (DOT) programs employ a health care worker to directly administer, observe and document a patient's ingestion of a medication.

Patients who must take medication in pill form often use a multi-compartment dispenser to help organize the task of taking the proper medication at the proper time. Patients who must take many pills per day at different times of the day frequently use a daily manual dispenser that has four compartments for one day. These compartments are designated AM, NOON, PM, Bed, or Breakfast, Lunch, Dinner, Bed, or some other set of designations, for instance, by time. The four compartments can be integral, or can be individual small boxes that are retained in a day-frame, so that each can be individually manipulated. Pill organizers typically can have seven of such daily four compartment boxes, arranged according to the seven days of the week. Such weekly organizers can typically include a frame that removably retains each of seven daily dispensers, so that each one can be individually removed and manipulated. Rather than four compartments, a daily system can have more or less compartments, depending on the complexity of the patient's medication regime.

Such manual medication systems are simple, and have both advantages and disadvantages. The advantages include that they are inexpensive and relatively easy to set up and use. A patient or a patient's aid determines which medications are required for each day, and the times of the day that they are required. The required pills are placed into the corresponding compartments, the compartments are closed and each day-set is put into the week-frame for safe-keeping. The patient or the patient's aide opens the appropriate compartment at the appointed times, removes the medication, and the patient consumes it. It is refilled with the proper medications at some time before the next day or week when the compartment or day-set is required to be used again and the process begins again. Other advantages are that the day-set or week-frame can be relatively easily transported to accompany the patient if the patient needs to be away from home for a day or more. They can be cleaned relatively easily. They are arranged physically in a manner that mimics a daily organizer, such as a calendar or a day-planner, and thus, are clear, typically, as to which medication has been designated to be taken at which time(s).

Medication organizing equipment as described above does have disadvantages. Some disadvantages relate to loading the medications into the equipment, and some relate to removing the medications. Further, these manual systems provide only rudimentary record keeping functions. Turning first to the loading disadvantages, many patients are on complicated medication regimes, and thus, it can be complicated to ensure that the correct medication is placed in the compartment that corresponds to the correct time to take that medication. Duplicate pill placement can take place, which could result in an overdose. Or, a placement can be inadvertently omitted, which might result in an under dose. Some patients can find it psychologically daunting to face the task of organizing all of the medications. Or they can simply be unable to do so cognitively, especially if their condition affects their cognition.

Turning to the dispensing disadvantages, a typical day-set contains four compartments, and a typical week-set contains seven day-sets, for a total of twenty-eight dose medication compartments. A patient might become confused as to which medication compartment to use at any given time. Even if not confused, a patient might open a medication compartment from the correct day, but the wrong time, or, perhaps, the correct time, but from the wrong day of the week (for instance, regarding a medication that is taken only every other day, or for three consecutive days, but not the following four). A patient can forget to take any medication at a prescribed time, open a wrong compartment or simply not take the medication for another reason. Additionally, a patient might forget that they have taken a given dose of medication, and might take an additional dose. If two people share responsibility for a patient, including, perhaps, the patient himself/herself, both people might give the patient a dose of the same medication, erroneously, resulting in an overdose.

Further disadvantages relate to the lack of real time remote visibility for caregivers or third parties to monitor compliance with the medication schedule. It is also beneficial to generate accurate records reflecting when medication has been taken, or accessed, and what medication has been taken.

In recent years, automated and semi-automated systems have been developed. Many of these systems have disadvantages of their own. They typically have many and complicated features. The user interfaces are overly complicated, and include multiple data read-outs and opportunities for input, similar in complexity to media recording equipment, or kitchen appliances, many of which remain un-programmed, with some features unused. Such systems intimidate and confuse many users, particularly elderly and infirm who require significant amount of medication at specific times. Ironically, the more one is in need of the system, due to the complexity of their drug regime, the greater the probability that they might be unable to use such a modern system. They are difficult to set-up and to program the drug regime. They are sometimes also difficult to use for dispensing medication, because of complex user interaction controls.

It has also been recognized that even audible and visual cues for taking the correct medication at the correct time can be difficult to follow, particularly in patients that suffer from diminished cognitive abilities or general confusion. This can be highly disadvantageous, as the patient can take the wrong medication at the wrong time, or take too many doses from the container.

Advances in telecommunications have made possible the integration of various systems into smaller devices. Telephones and other handheld electronic devices have been furnished with micro-recording devices, small media recorders and linked to the internet to provide a capability for real-time media links. Vulnerable patients now find themselves in instant communication with service providers in case of accidents. This is particularly useful in promoting independence and self-reliance among those individuals. But while this is convenient, it can lead to a plurality of devices with overlapping telecommunications capabilities, providing potential confusion to less-functional users.

It is therefore desirable to provide a medication dispensing system that is easy to use, easy to reload, can provide audible and visual cues and also ensures that only the correct medication can be taken at a particular time. The dispenser should be capable of monitoring compliance and communicating with various caregivers and other concerned individuals. The system should also be sized so that an elderly, or otherwise challenged, individual can easily see and manipulate the various compartments for dispensing medication.

SUMMARY OF THE INVENTION

This invention overcomes disadvantages of the prior art by providing a system and method for dispensing medication and a dispensing apparatus that comprises a plurality of compartments in an array within a housing, the compartments having respective lids, each of the lids being movable from a closed position to an open position, the respective lids each being secured in a locked configuration in the closed position. The apparatus has an actuator mechanism, operatively connected to a processor and that controls access to each of the compartments based on a pre-programmed schedule, the actuator mechanism constructed and arranged to selectively unlock each of the lids at a predetermined time so as to place the unlocked lid in an unlocked configuration that enables the lid to be moved to the open position. Each of the lids respectively includes a latch that is movable to selectively lock and unlock each of the lids. The compartments of the medication dispenser each receive a removable cup therein that is accessible when a respective of the lids associated therewith is in the open position. The compartments each include an illumination source that selectively operates when the respective of the lids associated therewith is in an unlocked configuration. The plurality of compartments is arranged in a plurality of approximately rectilinear rows and columns. The compartments each receive a removable cup therein that is accessible when a respective one of the lids associated therewith is in the open position. The dispenser has compartments that include a sensor for each that respectively senses access to medication associated with each one of the compartments. In an embodiment, the medication dispenser has an actuator mechanism. In an embodiment this actuator mechanism includes a motor that drives a belt or chain and an actuator element attached thereto that moves selectively between each latch on at least some of the lids so that each latch is moved discretely from the locked position to the unlocked position. In an embodiment, the dispenser can include four rows, each of which (or groups of which (e.g. pairs) is actuated by a separate motor. Alternatively, a single motor can be employed. In another embodiment, the belt can be arranged on a serpentine path that snakes through all or part of the array of compartments so that each one in the serpentine path is eventually engaged by the actuator element.

In an illustrative embodiment, the actuator mechanism comprises a plurality of bars arranged in each of at least a first direction and a second direction, crossing the first direction. Illustratively, the first direction and the second direction can be orthogonal/rectilinear and designated as a horizontal or "X direction and a vertical or "Y" direction. The bars are constructed and arranged so that, when a selected one of the bars arranged in the first direction and a selected one of the bars arranged in the second direction are each moved to an unlocking position, so as to unlock one of the lids associated with the selected one of the bars arranged in the first direction and the selected one of the bars arranged in the second direction. Illustratively, each of the bars arranged in the first direction are moved by a first cam assembly that selectively cams each of the bars on engagement therewith, and each of the bars arranged in the second direction are moved by a second cam assembly that selectively cams each of the bars on engagement therewith. Each of the bars arranged in the first direction can be spring loaded so as to be biased normally in a locking position when disengaged from the first cam assembly. Likewise, each of the bars arranged in the second direction can also be spring loaded so as to be biased normally in a locking position when disengaged from the second cam assembly. In this manner the system serves to lock each respective one of the lids associated with a crossing pair of the bars arranged in the first direction and the bars arranged in the second direction. In an illustrative embodiment the first cam assembly and the second cam assembly can each comprise a rotating camshaft having a plurality of eccentric lobes adjacent to ends of each of the bars arranged in the first direction and the bars arranged in the second direction, respectively, an apex of each of the lobes being located at a discrete rotational orientation about a circumference of the shaft that discretely engages one of the bars arranged in the first direction and one of the bars arranged in the second direction, respectively. Alternatively, the first cam assembly can comprise a single first cam structure on a first linear drive that moves approximately along the second direction (transverse to the first direction) and/or the second cam assembly can comprise a single second cam structure on a second linear drive that moves approximately along the first direction (transverse to the second direction).

The illustrative pillbox can also include an additional sensor (or sensors) to detect when a pre-filled refillable tray has been placed into the pillbox body. The sensor(s) can be an electromechanical, magnetic and/or a solid state electronic sensor in various embodiments.

Illustratively, medical alert systems can be linked to the telecommunications link within the medication dispensing system and function either by direct contact by the user or by relaying a signal issued through a wireless link to/from an alert device worn or carried on the person of the user. This linkage can reduce the overall number of telecommunications devices required and the subscription service fees can be conveniently combined. In another embodiment, the communication system can provide for two-way communication using audio and/or visual information transferred between the user and an exemplary alert service provider. This communication can help to determine the nature of injuries and/or health conditions of concern, if any, and the urgency of the situation. The two-way communication system can be arranged so that the communication does not require routing through the server and can be arranged to provide direct links. A telephone number or other address/identifier can be entered/dialed directly through the medication dispenser (for example, using a touch screen interface on the media display), and the built-in microphone and speakers provide the mechanisms for the audible two-way communication. In this manner a user is provided with the ability to directly speak with and hear from a service provider or other interested party. The overall communication system can also include a server that communicates with an interested party and that is interconnected to the processor via the communication system, the server being constructed and arranged to control a pre-programmed schedule for access to each of the cups based upon instructions provided by the interested party and enable monitoring by the interested party of access of cups and a status of the system. The communications system can also route signals to and from a service provider.

In various embodiments, the medication dispenser can illustratively provide audible, visual and other forms of cues/alerts, including an alert comprising a pre-recorded personalized audible and/or visual reminder. When the time for the predetermined alert arrives, the pre-recorded prompting reminder to take the dose is given by the pillbox in a friendly (or otherwise familiar) voice. By way of example, the alert can be in the form of a cute little grand-daughter advising the user, "Grandpa, time to take your pills." In addition, the return of the medication cup to the dispensing system can then prompt a gratification (or feedback) message; for example, the same little grand-daughter now saying, "Thank you for taking your medicine, Grandpa. I love you!"

The alert and gratification messages can be recorded by either recording the message into the built-in microphone/speaker assembly(ies) located on the local pillbox, or by using the server in which the message is either stored locally thereon in the pillbox data memory under control of the processor, or the message information can be stored remotely in the server (or both). This can be facilitated by a telephonic/network link into the server, or by accessing a recording function in the server—for example using a local computer (e.g. a personal computer (PC)) having a microphone an/or webcam functionality. This provides for a grandchild or other significant friend or relative to log into the server from a home computer, record and alert and gratification messages that are then either transmitted to the medication dispensing system at each alert time, or that are transmitted and stored within the memory of the medication dispensing system. This provides as well for a remote updating function for revising messages or substituting the current significant friend or relative with another.

In a further embodiment, the medication dispensing system is provided with a visual display. It is contemplated that the alert and gratification messages can be visually recorded using a webcam, cellular phone, or similar audio/visual interface device. This message can then appear on the visual display of the medication dispensing system and serve to reinforce the illuminated dosage alert.

Desirably, the recent miniaturization of visual displays utilizing liquid crystal display (LCD) and similar/equivalent technologies provides that the medication dispensing system can have a fold-out visual display or a visual display that is built into one or more of the surfaces of its body. The cover has a visual display that can function when the lid is closed or raised. The screen can be used to display a single image or to stream a series of images. The image can be interrupted at the alert time to visually display a reminder. In an embodiment, the screen can be interfaced with a media source and used to stream media output, such as streaming web program, or a digital interface utilizing a touch screen, as will be more fully set forth below. In an embodiment, the display can present active visual alerts for hearing impaired users (for example, streaming the words "TIME TO TAKE YOUR MEDS"). In a further embodiment, the visual display can be sited on the inside of a cover on the medication dispenser system. The geometry and construction of the display is highly variable in various embodiments. The screen can be rigid or can incorporate flexible screen technology—for example a roll-up display.

In an embodiment, the medication dispenser system is provided with an openable/closable cover, and is placed in a mount that places the medication tray at an angle relative to a table top. This angled arrangement allows the medication dispenser system to appear less medical and more of a design feature within the user's personal environment. The cover can include a screen that can be used to display a single image, stream a series of images or serve as a digital and/or media interface.

As set forth above, a display can be an interactive digital display that utilizes a touch screen mounted on the medication dispenser system. The interactive screen allows a user to interact with the server, request information, report on status and receive reminders of medical appointments and similar information. For example, a user can use the touch screen to call up the medication schedule, or inquire about drug interactions and side effects. The display can have a generic interface screen when engaged by a touch or by motion detection (via the camera for example using conventional software techniques) and a screen saver image when not engaged.

The display can be mounted on a sloped box having a sliding side compartment, according to an alternate embodiment.

The illustrative medication dispenser system as described above can also be interactive, feature pre-recorded messages, and have an interactive touch screen. In a further alternate embodiment, a media camera can be mounted so as to record the administration of medication. In this embodiment, the camera is activated at the time of the alert reminder to take the medication to record the administration of the medication that produces a clip that can be accessed and viewed later to confirm compliance with the therapy regime and potential complications. This also provides remote monitoring by a healthcare professional if desired. The display can be fitted with a built-in media camera for two-way communication using a web-based communication system, such as a voice-over-Internet Protocol system (for example, SKYPE® or its equivalent service). This allows interaction between the user and a remote healthcare professional (or other interested party) for feedback, therapy questions or messaging. This two-way communication can also be integrated to work with an on-board medic alert system, as described above. More generally, the system can include messaging functions that provide a variety of scheduled and unscheduled information in voice, text, pictorial and/or media form. This information can be related to the scheduled administration of one or more medications, or can be a more general message, such as an appointment, life task (e.g. bedtime reminder/wakeup call, meal call, etc.), or a general information member (e.g. a commercial message). To this end, the medication dispensing system can include, operatively connected to the body, at least one of (a) a messaging system that provides at least one of audible, pictorial, textual and media messages to the user over at least one of the communication network and a third party network and (b) a communication system constructed and arranged to deliver messages from the user over at least one of the communication network and the third party network. More generally, the camera can be employed to acquire images that are used by a user or others as part of the display, or for other purposes. A USB or other data transfer device can also be provided on the housing to load and unload images and/or other data.

BRIEF DESCRIPTION OF THE DRAWINGS

The invention description below refers to the accompanying drawings, of which:

FIG. 15B is a top perspective view of the camshaft and bar/slider arrangement for the upper portion of the housing body of FIG. 15A;

DETAILED DESCRIPTION

I. Background Art

Figure 1:
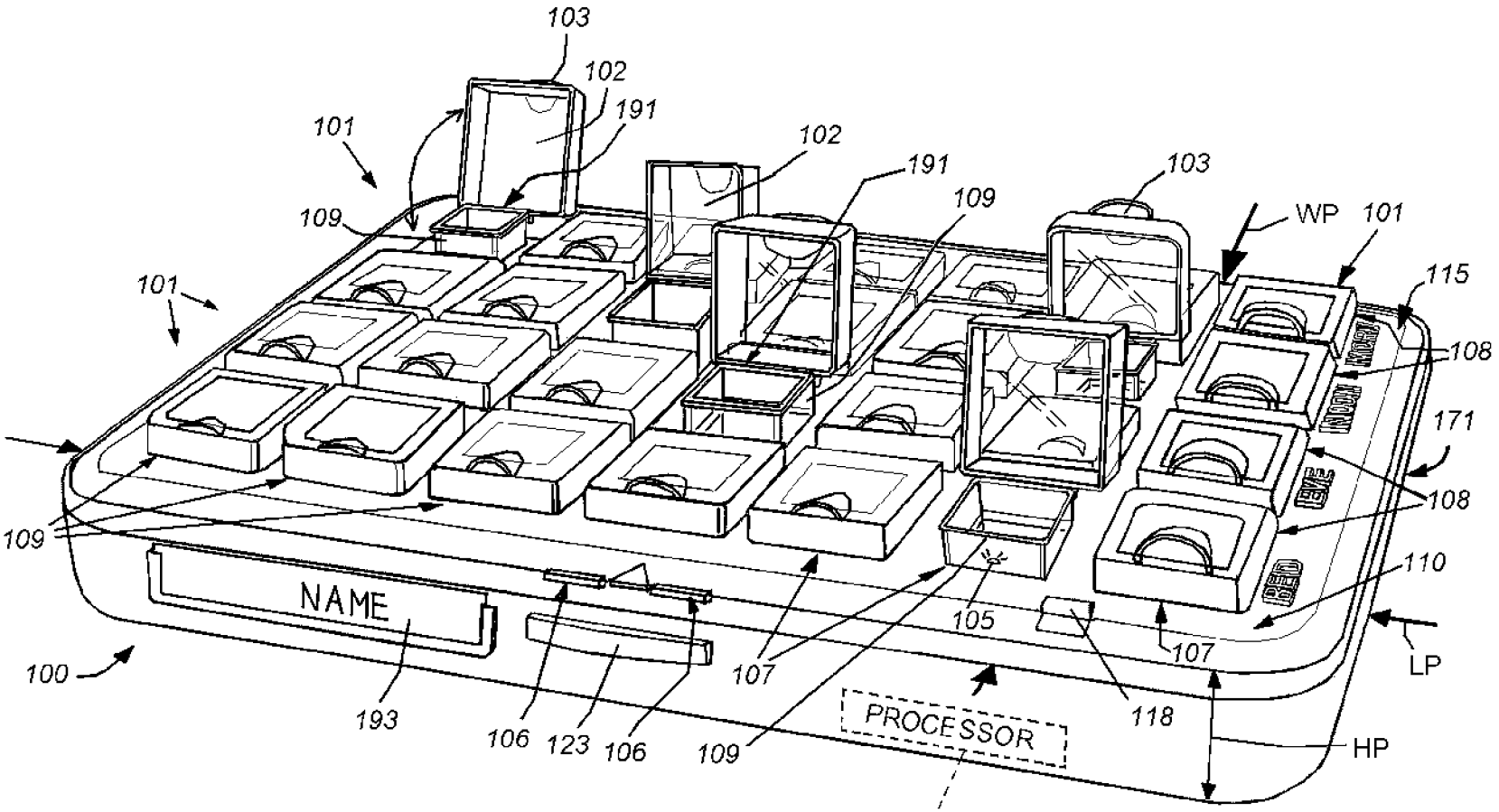
FIG. 1 is a perspective view of a reloadable medication dispenser, by way of background, which communicates status to caregivers and other concerned individuals and that provides audible and visual cues to the patient when medication should be administered according to an embodiment.

FIG. 1 shows an embodiment of a medication dispenser 100 that is part of an associated system for dispensing medication shown and described in commonly assigned U.S. patent application Ser. No. 12/606,643, entitled INTERACTIVE MEDICATION DISPENSING SYSTEM, by Eran Shavelsky, et al, the teachings of which are expressly incorporated herein by reference as useful background information. The medication dispensing system 100 includes one or more medication "compartments" 101. The compartments 101 are set and arranged in a removable tray 115. Each compartment 101 is covered by a lid 102, which is opened using the handle 103. As used herein and described more fully below, the term "compartments" refers collectively to a cup, a moveable lid covering the cup and an orifice within the body in which the cup resides. The moveable lid 102 can be furnished with a variety of movement devices, included a hinge assembly. As used herein and described more fully below, the term "orifice" refers to an individual well that is designed to hold a single removable cup 109. Each compartment 101 is constructed and arranged to allow removal and replacement of the respective cup in order for a user to access the medication contained therein. The cups are designed to contain medication doses of a predetermined maximum size. The transparency or semi-transparency (i.e. translucent) of the lid 102 lends to easy medication identification and visual cue viewing. The compartments can be arranged in column sets 107 and in row sets 108. In this embodiment, there are seven columns for each of the seven days of the week. There are also four rows for each of four times within a day that medication can be needed. Indicia for bedtime (BED), evening (EVE), noon (NOON) and morning (MORN) are depicted by way of example. Indicia for each day of the week can also be provided (e.g. SUN-SAT, not shown). The indicia can alternatively be provided in other languages, units of time, such as dates and hours. It is also expressly contemplated that the number of rows and columns can be highly variable in other embodiments and be more or less than depicted in the exemplary embodiment. Likewise, not all compartments need be filled with medication and the actual time in which medication is taken can differ from that shown. The visual (and optionally, audible) cues, combined with system programming, generally provide the actual time at which the medication in a particular compartment should be taken, as described further below.

The dispenser status is indicated by a status Light-emitting diode ("LED") 105 that (in this embodiment) is located at the bottom of each compartment 101, beneath each cup base. Since the cups are transparent or translucent, the LED illuminates the cup and lid in the manner of a light pipe, spreading the light throughout the structure and concentrating it at corners and edges. The LEDs 105 have several functions relating to the status of the unit and the particular compartment. A particular status can be indicated by changing colors and/or flashing. Medication dose integrity and security is maintained by a somewhat conventional spring latch (not shown) that bears upon the edge of each lid. The force of the latch can be overcome by bearing upon the handle 103 with minor force. The spring latch ensures that the medication in each of the individual compartments 101 does not fall out. Note that the LED 105 can be alternately placed at another location (e.g. a side wall) with respect to a particular compartment 101 so as to indicate the status of the medication contained therein.

The dispenser 100 has a bezel door assembly 110 which functions as an extended protective covering for the compartments 101. The bezel door assembly 110 allows for the utilization of a removable pharmacy pack, or for group treatment of the compartments, thus allowing for easy refill. Like other components of the dispenser 100, the bezel door assembly 110 is composed of a durable, lightweight material, such as a polymer or lightweight metal, and is joined with the main dispenser body 171 at hinges (not shown) located on the rear side of the unit. The hinges permit the bezel door assembly 110 to be rotated from a closed position as shown, to an open position in which the lids 102 (which are hingedly carried on the bezel door assembly 110) are collectively moved away from compartments 101 and cups 109 allowing access to all compartments/cups at once.

It is noted that opening and closing the bezel door assembly 110 actuates an appropriate sensor within the bezel door (not shown) that causes a report to be sent from the dispenser's central processor to the remote central server via a wireless connection. In this embodiment, the dispenser is in wireless communication via cell, or other RF carrier signal, with a central server (or other networked arrangement of processors) that controls the functions and monitors the status of the unit. In particular, the server communicates with an interface that is accessible by caregivers and other interested individuals. This access can be remote and provides information based on the status of the dispenser. This information can include the predetermined times at which each of the plurality of compartments is accessible. The interface allows the scheduling of cues (light and audible) with respect to various medication compartments so that the patient is instructed to take the medication from the cup 109 in that compartment 101. The unit senses when a cup has been removed to take medication via a sensor (e.g. a micro switch, not shown) in the base (or other location) of each compartment. If medication is not taken within a scheduled time interval (as sensed because the micro switch was not tripped), then the server can notify interested individuals via a text message, email, telephone call and/or other communication form. Likewise, each opening and closing of the bezel door assembly 110 is a discrete event that is recorded in the central server database and changes the state of the system. This feature is advantageous in directing the user to initiate a refill of the cups 109, either with or without the refilling of the overall tray 115. The detection of the movement of the bezel door assembly also advantageously provides general information about the activity of the opening and closing of the dispenser. A general status light 118 that can flash and/or change color depending on unit status is also provided at a convenient and visible location on the dispenser 110.

The dispenser 100 is provided with an Alternating Current ("AC") power adapter and a Direct Current ("DC") back-up battery (not shown) which allows the unit to function independently. A speaker (also not shown) allows the unit to provide the user with auditory cues. The dispenser 100 contains a compact integral central processor and circuitry (shown schematically in phantom) 120. In the depicted closed orientation, the dispenser 100 has a length LP of approximately 14.5 inches, a width WP of approximately 10 inches and a height HP of approximately 2 inches. However the actual dimensions are highly variable, and in various exemplary embodiments HP can range from 1 inch to 3 or more inches, LP can range from 8 to 24 inches and WP can range from 6-12 inches. It is desired that the unit be large enough to remain prominent in the life of the patient and be easy to use, even when the patient has diminished visual and/or motor skills. In an embodiment, the cups 109 are generally square and slightly outwardly tapered toward their tops. They have an opening dimension of approximately. As described generally above, individual medication doses are stored in cups 109. The cups 109 are easy to handle and fabricated from a durable, lightweight material. The cup 109 can be translucent or transparent to allow for easy medication identification and visual cue viewing and also to transmit light as described further below. The cups 109 can alternatively be provided with individual lids (not shown) to allow for transportation of an individual cup. The cups, as depicted, have a square profile. However, in an alternate embodiment herein the cups can have a rectangular, circular, ovular or other desired profile. Notably, the depicted square profile causes it to be slightly more difficult to remove the medication dose from the squared container and encourages the user to remove the cup 109 completely from the dispenser 100, which in turn, generates a report on the medication event, as described generally above. The exemplary square profile cup 109 has a height of approximately one and a half inches and a width on each side of approximately one inch. The dimensions can be slightly greater or less, based on a need for a larger cup or for a smaller overall profile for the dispenser 100. The individual cups 109 can also define a small indent (not shown) in the base/bottom of each cup that bulges slightly upwardly to correspond to the position of the exemplary LED 104 within the well of orifice of the respective compartment. Note that while a discrete LED is provided, an alternate light source, such as a fiber optic tip can be used in alternate embodiments.

As described, the LEDs 105 under each compartment provide desired visual cues to the user and a communication connector which helps the unit optionally communicate with a central server for monitoring purposes. Alternatively, the LEDs can be triggered to remind a patient to take an appropriate medication that is not in pill-form, e.g. injections, breathing treatments, or other medical treatments as programmed by the server and interface.

The compartment lids 102 can be fabricated from a durable, lightweight material and can be transparent or translucent to allow for easy medication identification and visual cue viewing, and also to transmit light therethrough. Each lid 102 is affixed to the tray 115 by operation of a hinge 191 that is pressed or clipped to the tray 115, and which allows hinged opening of the lid 102. When closed, the lid 102 isolates and protects the medication dose within the cup 109. Likewise, the lid prevents the cup 109 from being removed and ensures that the cup maintains the sensor in its current (untripped) state. As described, each lid 102 is provided with a protruding tab handle 103 that serves to provide a catch for a fingernail, or fingernail-like object, and facilitate opening. The shape and size of the handle is highly variable. In some embodiments it can be omitted, and a fingernail can be placed under the bottom front edge of a lid 102 to lift it. The main dispenser body 171 is also provided with a bezel button 123 that actuates the latch mechanism 106, and that allows for opening of the hinged bezel 110 when needed. The latch mechanism 106, likewise, secures closure of the bezel 110 and prevents its accidental opening, which can otherwise cause all medication and/or cups to accidentally spill from the dispenser. While not shown, a key lock can be provided to the bottom (or another location) of the dispenser body 171 to prevent the bezel 110 from opening, even when the latch mechanism 106 is actuated. The key can be retained by a pharmacist or other interested individual. This locking functionality enhances the security of the unit and, in combination with the automated lid locking and unlocking feature described below, renders the device highly secure against inadvertent/improper access or loss of medication from the dispenser. In an exemplary embodiment, the main dispenser body 171 can be furnished with a name tag 193 that is depicted as a slotted card holder. Alternatively, the name card can be printed on a sticker or an attached LED strip or another device that establishes the identity and ownership of and by the user.

II. Illustrative System for Automated Locking and Unlocking of Compartments

The above-described embodiment of the dispenser and associated dispensing system is highly effective and useful in dispensing medication to patients and monitoring their compliance with the caregiver's medication administration schedules. However, despite the use of visual and audible cues, it is still possible for medication to be inadvertently removed from the wrong compartment at the wrong time, leading to confusion or even a possible overdose. Likewise, it is possible for a plurality of lids to be accidentally opened at once, leading to the possibility of loss of medication from those compartments. Accordingly, FIGS. 2-7 show an illustrative dispenser 200 that is constructed and arranged to perform the various audible and visual cues described above, and provides the same communication and monitoring functionality as the above-described dispenser 100 (and is constructed from similar materials with similar dimensions, etc.), but that also includes a mechanism for ensuring that lids are opened only when the respective medication is scheduled for administration. Since the illustrative embodiment is otherwise functionally similar to the above-described dispenser 100, the following description will focus upon the mechanism for automated locking and unlocking of lids with respect to various compartments/cups. Note that the processor and associated circuitry (see processor 120) includes motor control functions that operate the locking mechanism so that it operates with respect to each compartment as that the medication in that compartment is scheduled for administration. Thus, the compartment will exhibit visual cues, be monitored for cup removal, and will now also be unlocked so that the cup can be removed by the patient.

Figure 2:
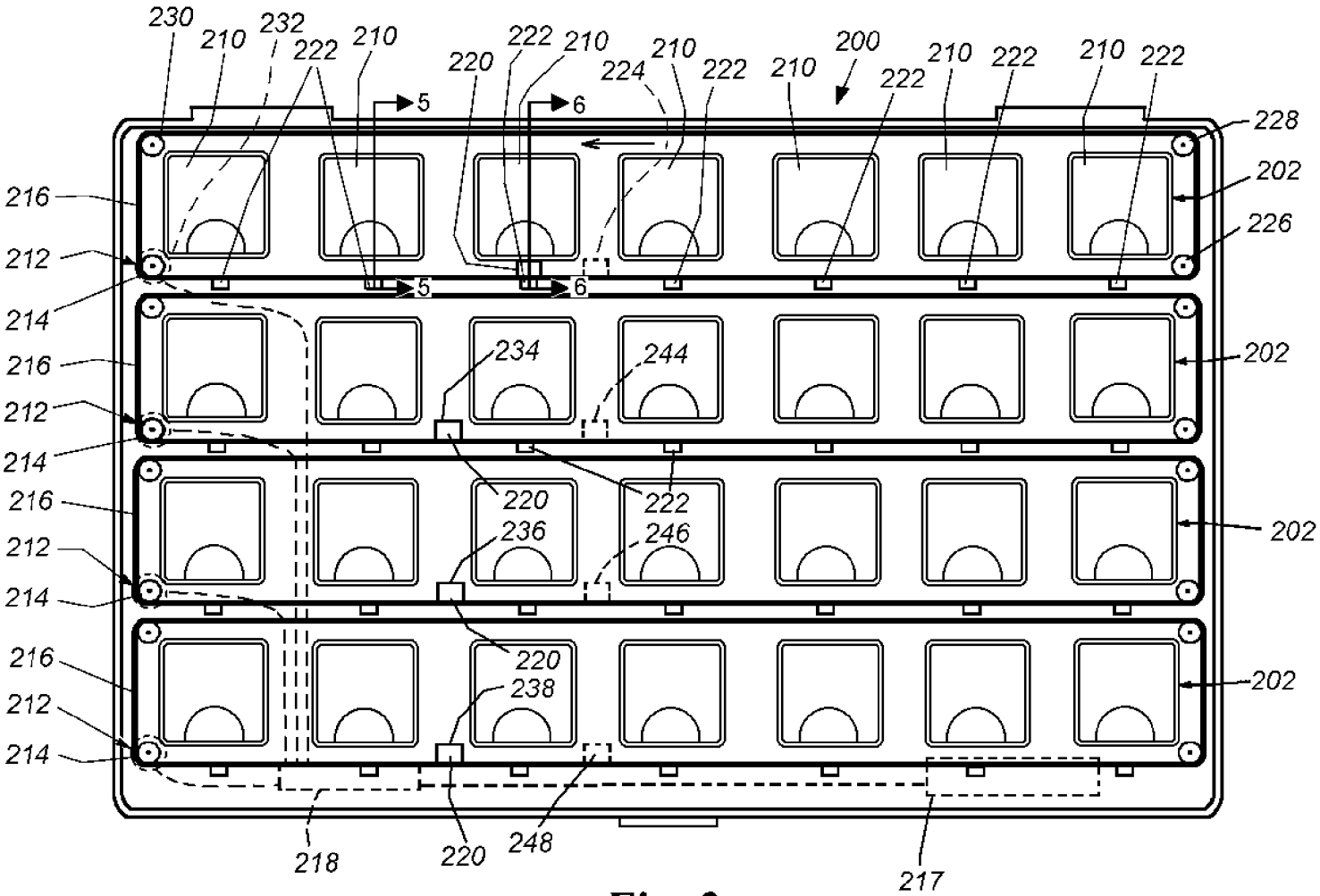
FIG. 2 is schematic top view of a reloadable medication dispenser having an automated lid-locking and unlocking mechanism according to the illustrative embodiment.

In FIG. 2, the overall dispenser 200 is depicted. In this embodiment four rows 202, each having seven compartments 210 are provided. In the further views of FIGS. 3-7, a single row of the dispenser 200 is depicted so as to focus on the locking and unlocking mechanism that operates in that row. In the illustrative embodiment, each row is serviced by its own gear mechanism 212 and associated motor 214. The structure and function of the mechanism in each row is essentially the same. The rows are actuated one at a time by a signal that begins at the processor 217. The signal is given to the motor control 218 that instructs the designated motor 214 to set the associated gear 216 and belt 218 in motion. Each belt 218 includes an integral carriage 220. The features of the carriages will be described more fully below.

The motor can be any acceptable type with sufficient output torque to perform the functions specified herein. For example, a stepper or servo motor, or a motor with separate encoder that tracks the relative position of the mechanism can be employed. Other known mechanisms can be employed. Other known mechanisms for sensing motor position can also be employed.

When a carriage 220 is moved, it advances from a rest position to a position where it engages a selected latch mechanism 222. This in turn unlocks the designated latch and allows access to the dose contained in the compartment. When the scheduled time interval for administering the designated dose has elapsed, the signal is given to advance move the belt and advance the carriage to a rest position 224 and the next row is engaged. Each of the carriages for a given day are their in rest positions, awaiting a scheduled activation and movement. In this embodiment, they are resting in positions 234, 236 and 238. Each is in turn activated and moves to engage its respective latch mechanism and in time, advance to their next rest positions 244, 246 and 248. This cycle is repeated for each day.

When a row is completed, the carriage is advanced sequentially around tension wheels 226, 228 and 230 to a beginning rest position 232. This cycle is repeated as each row is completed. It is expressly contemplated that a chain can be provided instead of a belt and functions in a similar manner to the belt.

Figure 3:
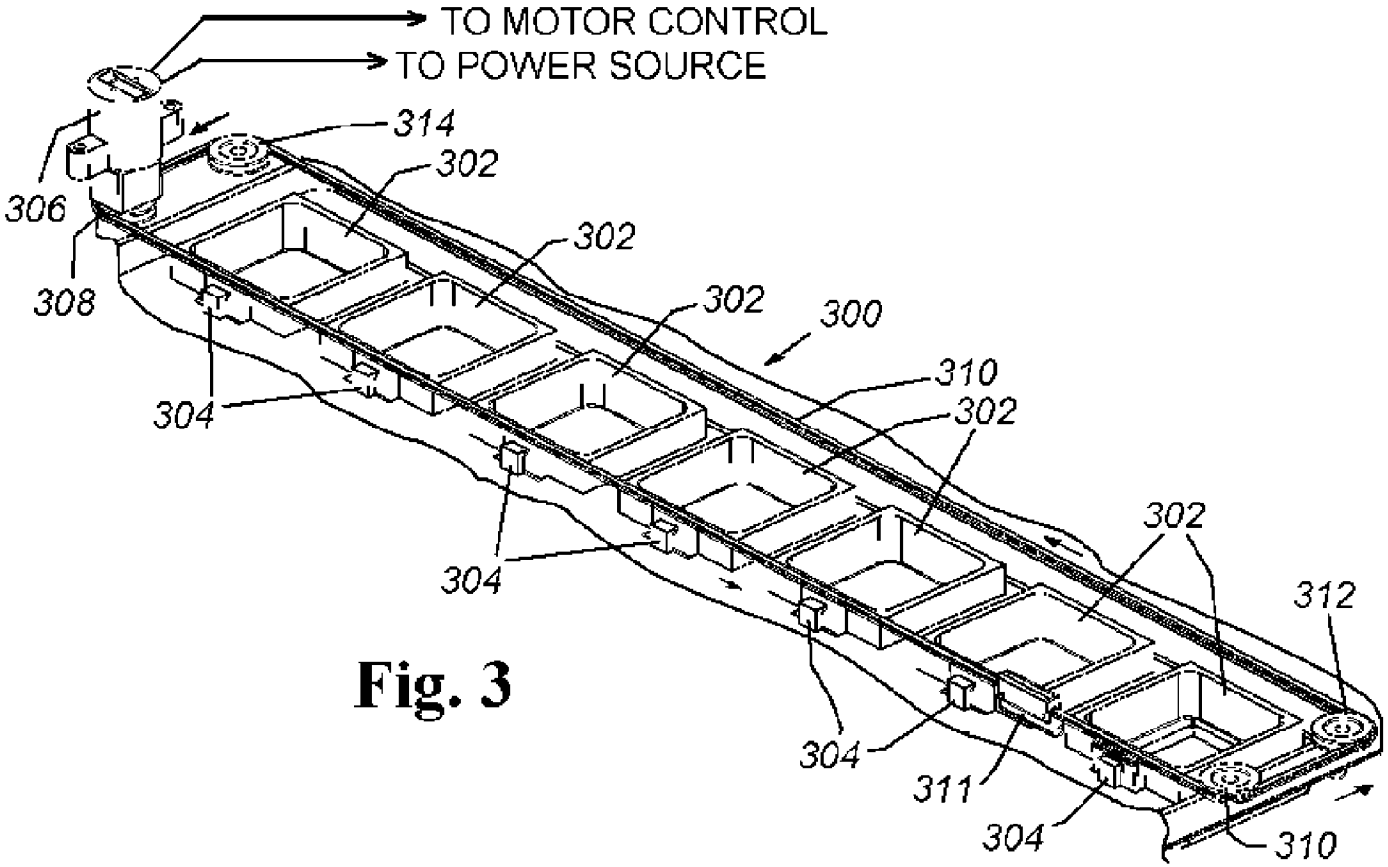
FIG. 3 is a perspective view of a discrete row of compartments for receiving medication cups and the associated locking and unlocking mechanism for the lids thereof according to the illustrative embodiment.

FIG. 3 is a view of a single discrete row 300 of the medication dispenser as set forth above in FIG. 2. The row is furnished with seven compartments 302, each with its own latch (not shown) and latch mechanism 304. The drive motor 306 and gear mechanism 308 are connected to a belt 310. The carriage 311 is attached to the belt and is depicted here as being in a rest position between latch mechanisms. The belt is held in place by three tension wheels 310, 312 and 314 and the gear mechanism 308. In this embodiment, the belt travels in a counterclockwise direction relative to the row. The carriage 311 can be affixed to the belt and/or by use of pegs, a snap-fit and/or adhesive, or held tight by use of bolts.

Figure 4:
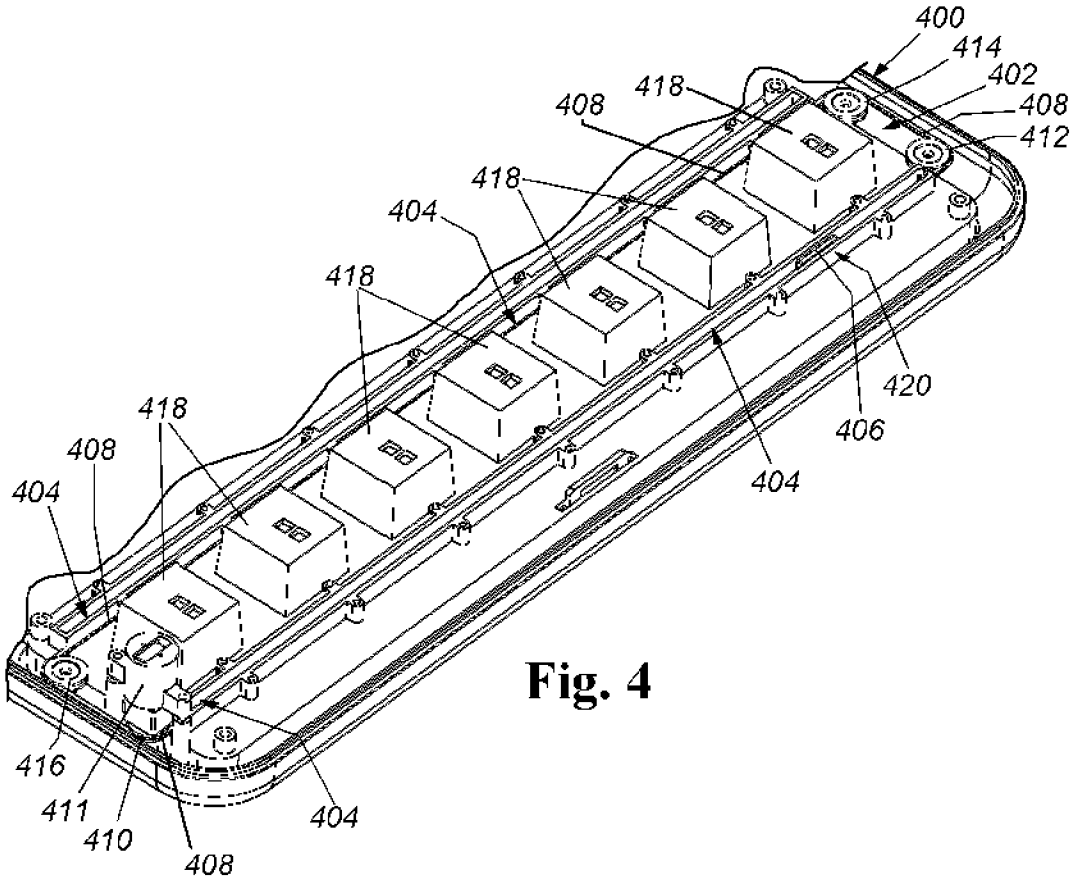
FIG. 4 is a perspective view of the bottom of a discrete row of compartments for receiving medication cups and the associated locking and unlocking mechanism for the lids thereof according to the illustrative embodiment.

FIG. 4 is a perspective view of a portion of the inside of the bezel cover 400 of the medication dispenser and depicts a single row 402 and the track 404 of the belt-driven carriage 406. As set forth above, the belt 408 is held in place by the gear 410 of the drive motor 411 and tension wheels 412, 414 and 416 and rides within the track 404. It is expressly contemplated that other driving and guiding structures can be used in place of tension wheels or the track as shown. The bottoms of the compartments 418 are shown. The carriage 406 is depicted in a rest position 420.

Figure 5:
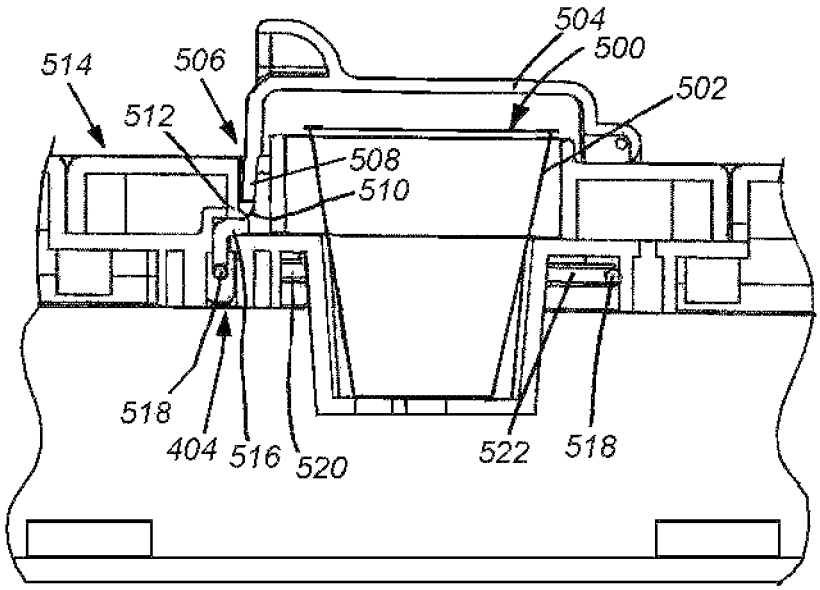
FIG. 5 is a side cross-section view of a discrete row of compartments for receiving medication cups and the associated locking and unlocking mechanism for the lids thereof taken along line 5-5 of FIG. 2.
Figure 6:
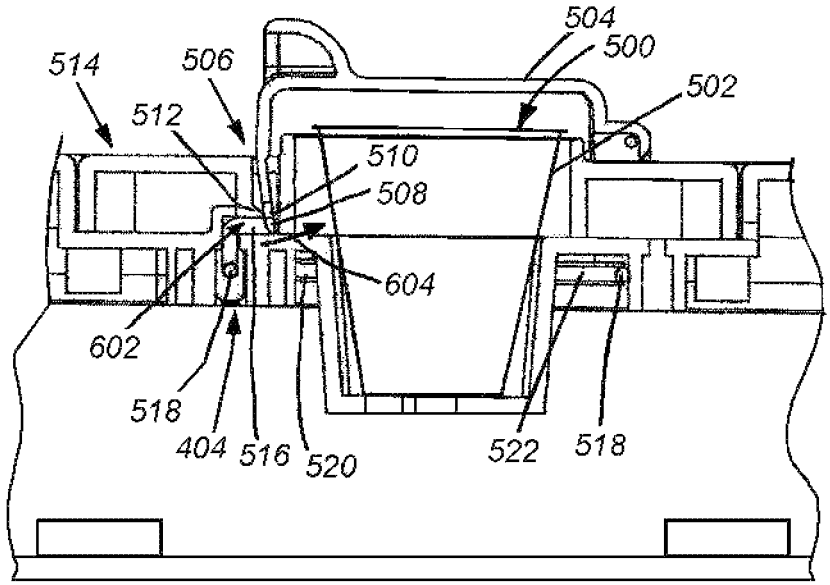
FIG. 6 is a side cross-section view of a discrete row of compartments for receiving medication cups and the associated locking and unlocking mechanism for the lids thereof taken along line 6-6 of FIG. 2.

FIGS. 5 and 6 are cross-sectional views that depict the operation of the locking mechanism for the compartment latches. In FIG. 5, a compartment 500 is furnished with a cup 502 and a compartment lid 504. The lid 504 is secured by a latch 506 that is furnished with an integral door tab 508. The door tab has a window 510 that is engaged and secured by a prong 512 that is part of the cover 514. As set forth above, a carriage 516 is mounted on a belt 518 that is secured around the gear 520 of a drive motor (not shown) and three tension wheels 522. One of the three tension wheels is visible in this view. In FIG. 5, the carriage 516 is in a resting position.

Referring now to FIG. 6, the drive motor (not shown) has been instructed to advance the carriage 516 and unlock the compartment lid 504. The leading edge 602 of the carriage 516 makes contact with the door tab 508 and urges it in a rearward direction, putting it under tension. When the carriage has advanced to the unlock position, the prong 512 no longer engages the window 510 and the lid 504 can be opened for administration of the contents of the compartment. Once the designated dosage time has passed and the carriage moves to its next rest position, the tension in the prong urges it to return to its proper orientation and the window 510 once again engages the prong 512 and secures the lid 504.

Figure 7:
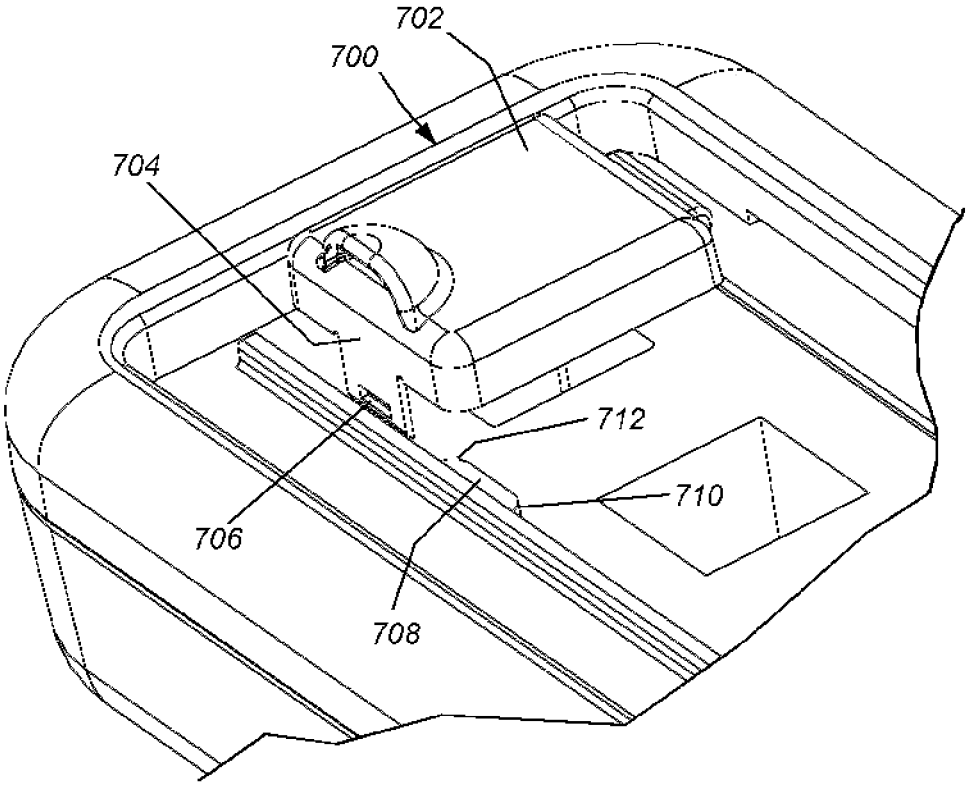
FIG. 7 is a perspective view of a discrete compartment for receiving medication cups and the associated locking and unlocking mechanism for the lids thereof according to the illustrative embodiment.

FIG. 7 is a close-up perspective view of a representative compartment 700 and depicts the orientation of the lid 702 and the door tab 704. The tab 704 includes a window 706 that engages a prong (not shown) in the manner set forth above to lock the lid 702. A portion of a carriage 708 is visible and in a resting position. The carriage has a rounded profile at each end 710 and 712. This rounding accommodates the movement of the prong in a uniform manner and avoids "snapping" motions, thereby extending wear and reducing mechanical failure. Note that the carriage can travel out of sequence to any point designated by the controller. Thus, if not all compartments are full, other lids can be opened non-sequentially at intervals designated by the controller.

III. Further Embodiments

While the above-described embodiment provides an efficient and highly effective mechanism for locking and unlocking the lids of discrete cups and compartments within the dispenser, it is expressly contemplated that other types of mechanisms can be employed—for example those with fewer or more than four motors, those that act on columns, rather than rows and those that use linkages other than belts and chains to move an actuator around the dispenser or that directly lock and unlock individual lids (e.g. a solenoid operatively connected to one or more latches). With reference now to FIGS. 8-13, an alternate embodiment of the dispenser 800 is shown. This embodiment uses a single motor 802 to drive a carriage 804 around a serpentine track 806 that accesses each of the lids in the overall arrangement of compartments in turn.

Figure 8:
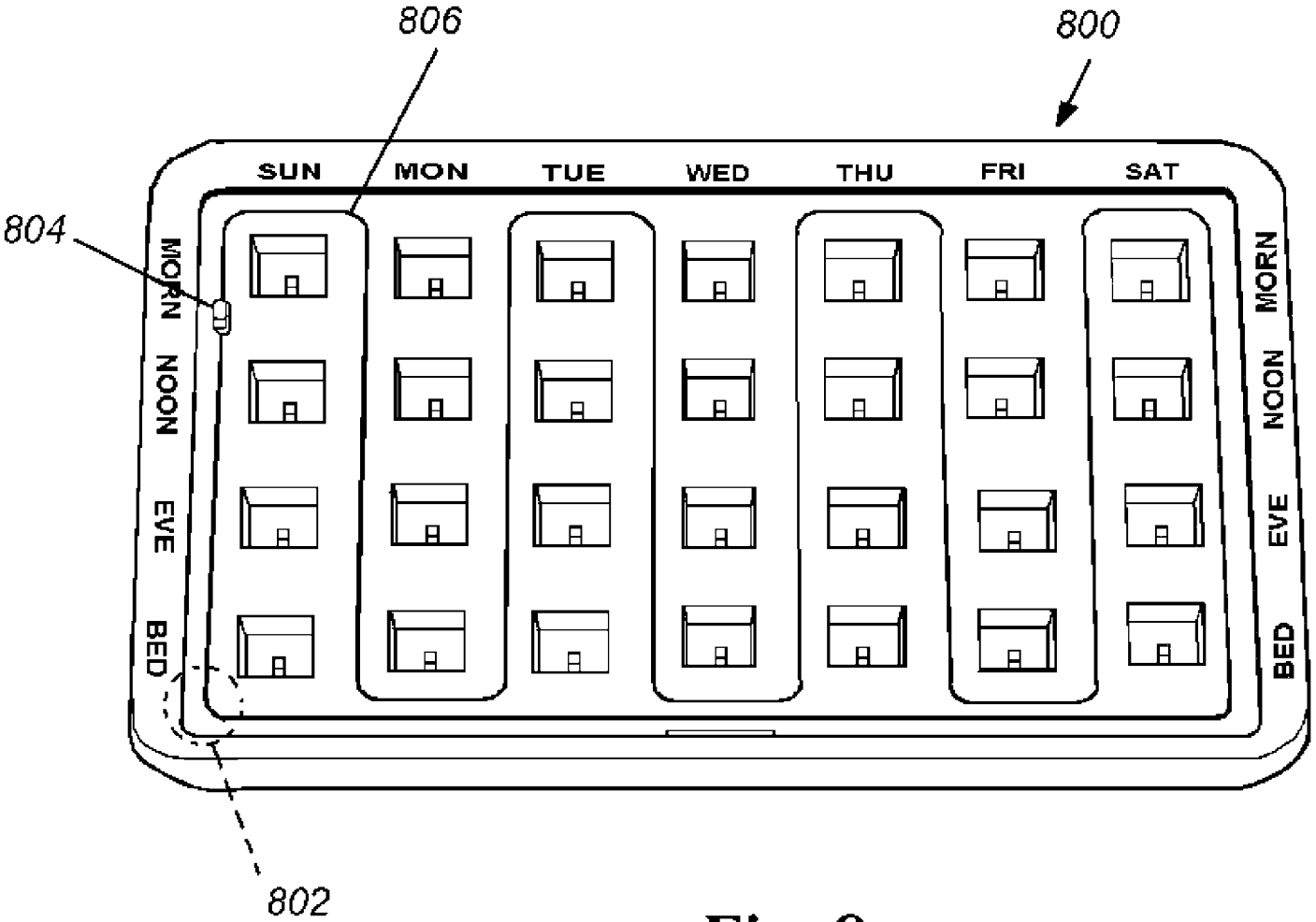
FIG. 8 is a front view of a reloadable medication dispenser having an automated lid-locking and unlocking mechanism according to an alternate embodiment.
Figure 9:
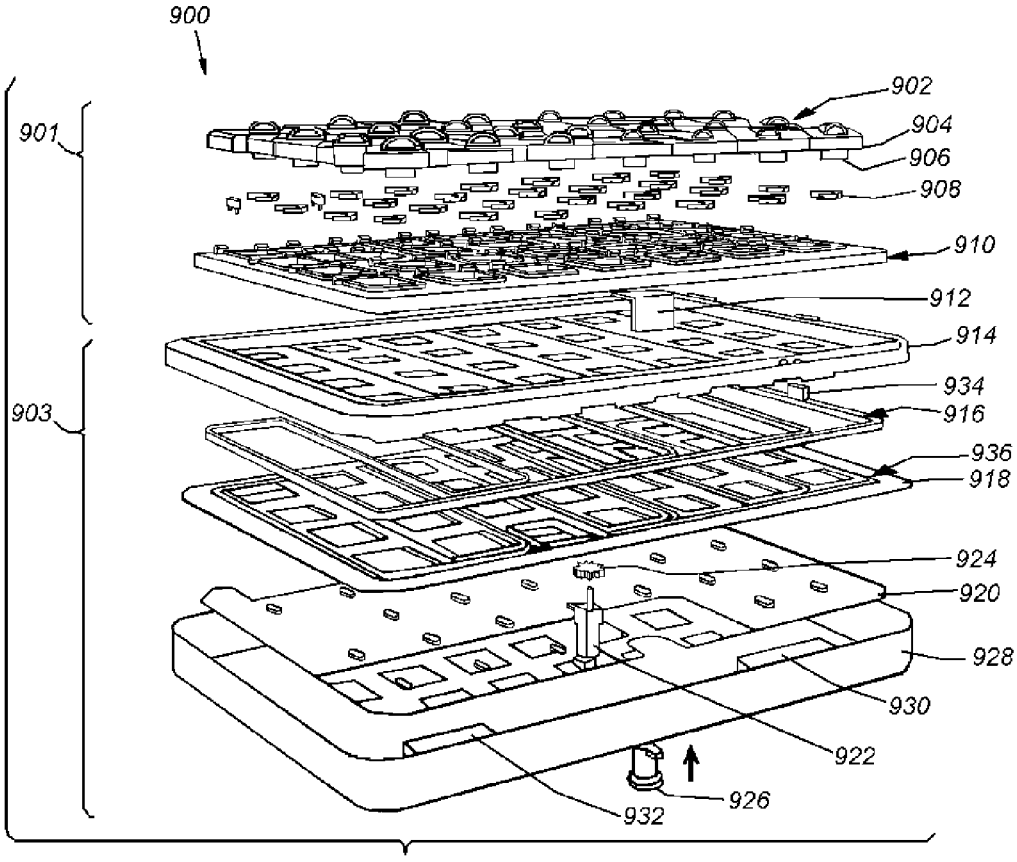
FIG. 9 is an exploded view of a reloadable medication dispenser having an automated lid-locking and unlocking mechanism according to the alternate embodiment.

FIG. 9 is an exploded view of the embodiment of FIG. 8. The twenty-eight compartment lids 902 each have a locking tab 904 with a window 906 that function in a manner similar to the tab 508 and window 510 set forth above. Each lid has a corresponding latch mechanism 908, the properties of which will be set forth below. The bezel 910 and bezel latch 912, together with the lids 902 and latch mechanisms 904 comprise the top 901 of the dispenser 900. The dosage cups are not present in this view. The bottom portion 903 is comprised of a top housing 914, a drive belt and/or chain 916, a track cover 918, the light array 920, a drive motor 922, gear 924, dispenser lock 926 and bottom housing 928. The bottom housing 928 includes a processor 930 and motor control 932. The bottom housing also includes a battery (not shown) for remote operation. In this embodiment, the carriage 934 is mounted on the drive belt 916 and travels in the serpentine track 936.

Figure 10:
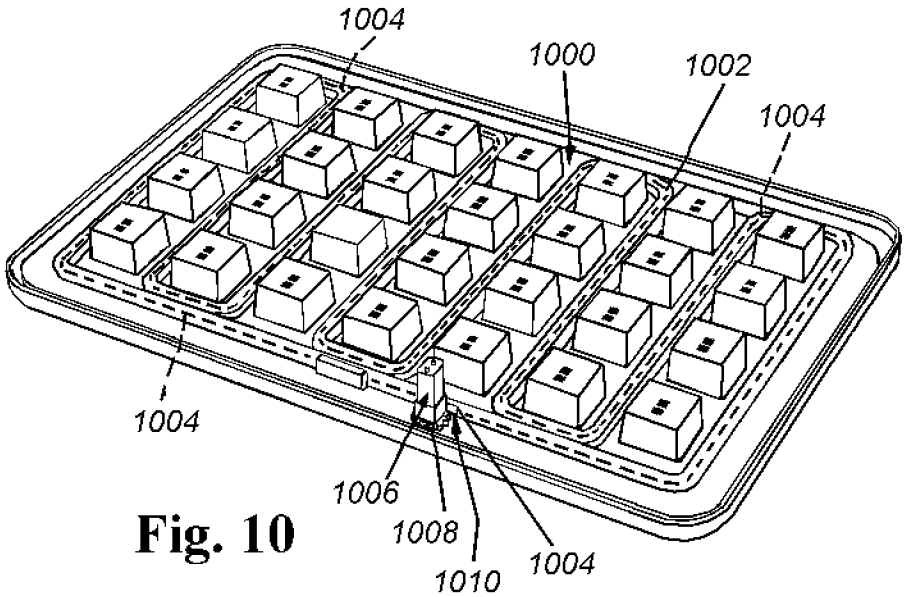
FIG. 10 is a perspective view of the bottom of compartments for receiving medication cups and the associated locking and unlocking mechanism for the lids according to the alternate embodiment.

FIG. 10 is a view of the bottom of the top housing of the alternate embodiment of FIG. 8. The track cover 1000 has a serpentine track 1002 that is formed as part of the track cover and does not require a plurality of tension wheels. The belt 1004 travels within the track 1002. The track 1002 is sized according to the dimensions of the belt 1004. The single drive motor 1006 has a gear 1008 that engages the belt 1004 at a window 1010 in the track.

Figure 11:
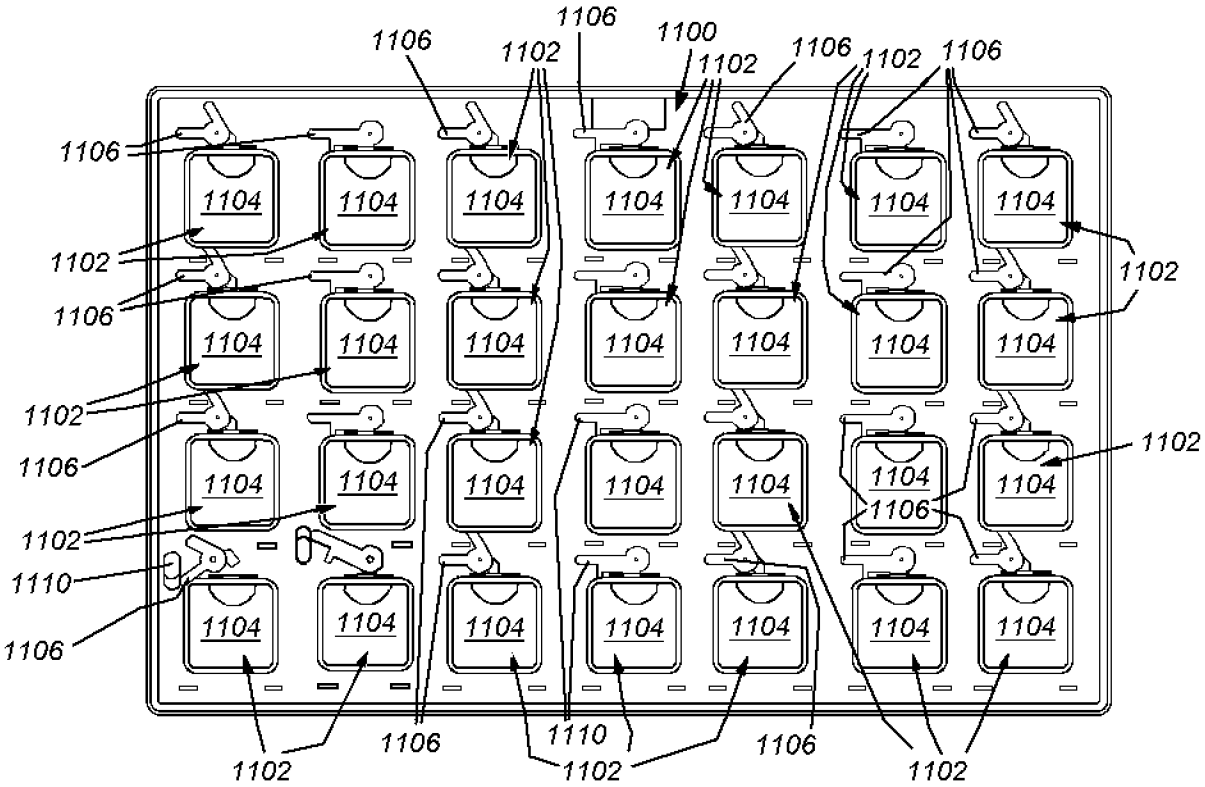
FIG. 11 is a view of the bottom of a reloadable medication dispenser having an automated lid-locking and unlocking mechanism showing the latching mechanisms according to the alternate embodiment.

FIG. 11 is a view of the inside of the bezel assembly 1100. Each of the compartments 1102 has a corresponding lid 1104. The bezel assembly 1100 includes spring-loaded door latches 1106 that engage each lid 1104. The function of the latches will be set forth more fully below. The carriage 1110 is shown unattached to the belt for reference purposes.

Figure 12:
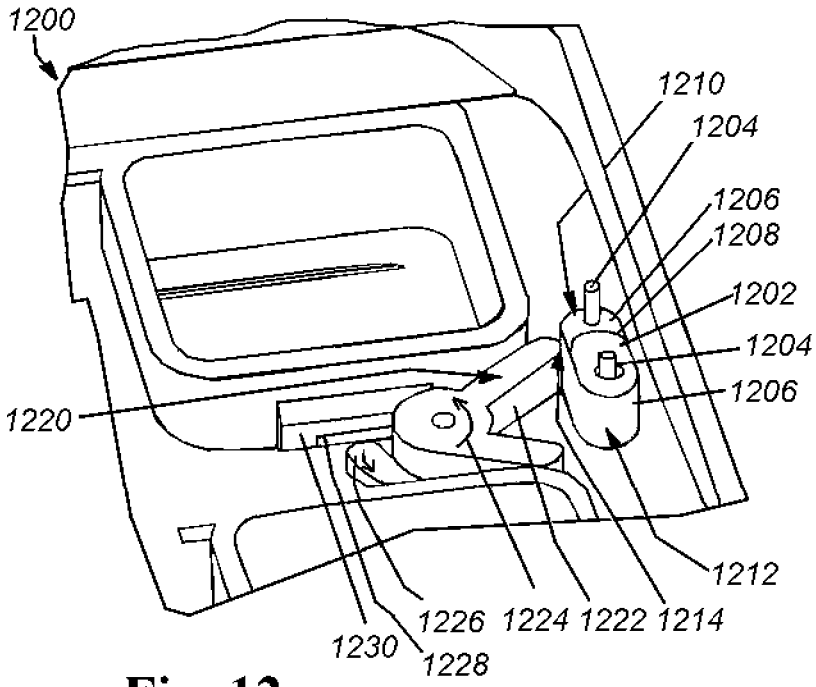
FIG. 12 is a perspective view of the latching mechanism for a discrete compartment for receiving medication cups according to the alternate embodiment.
Figure 13:
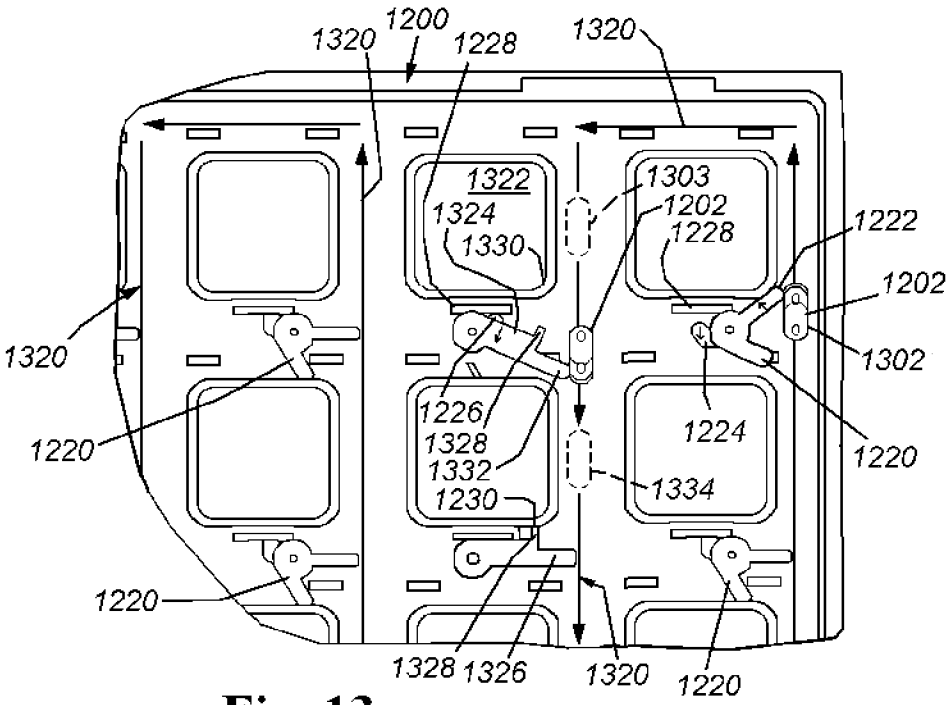
FIG. 13 is a view of a reloadable medication dispenser and the latching mechanisms for receiving medication cups according to the alternate embodiment.

The function of the latches is described in FIGS. 12-13. FIGS. 12-13 are both views of the inside of the bezel assembly 1200 and depict the carriage 1202 moving in the serpentine path without an attached belt.

FIG. 12 depicts the carriage 1202 engaging a latch 1220. The carriage is shown from below and in this embodiment has two mounting prongs 1204 for use with a drive chain. The carriage 1202 is rounded at each end 1206 for ease of engagement and to avoid a "snapping" action that might cause mechanical failure or reduce the longevity of the parts. The carriage 1202 has a joint 1208 that is the junction of the two portions 1210 and 1212. The articulation created by the joint eases the carriage through the corners of the serpentine track. It is expressly contemplated that the carriage can be a shorter, single unit rather than an articulated unit. The leading edge 1214 of the carriage makes contact with the arm 1222 of the latch. The arm 1222 is rounded to ease the contact. As the carriage 1202 advances, it forces the latch to rotate away from the carriage. This movement in turn causes the lock tab 1226 to withdraw from the window 1228 of the door tab 1230. This loads the spring (not shown) inside the latch 1220 such that when the carriage moves beyond to its next rest position, the spring will cause the lock tab 1226 to return to window 1228 and secures the compartment lid.

FIG. 13 depicts a carriage 1202 in two positions 1302, 1304 as it moves along the serpentine path 1320. Again, it is expressly contemplated that any lid can be opened in response to instructions from the controller and thus, not all lids are necessarily opened sequentially. The carriage in position 1302 engages latch arm 1222 and forces it back, causing the lock tab 1226 to withdraw from the window 1228 and unlocks the lid for administration of the medications. After the dosage time has ended, the carriage moves along its path 1320 to a rest position 1303. When the carriage moves again, it now engages the next compartment 1322. The latches 1324 and 1326 differ from the latches 1220 in that these have a stop 1328 mounted so that they will not rebound off of the cup wall 1330 and reduces the wear on the parts. The leading edge of the carriage 1202 engages the arm 1332, causing the arm to move in the same direction and loading the spring with tension. The movement causes the lock tab to withdraw from the lock 1228 and frees the lid for access to the medication. Once the carriage has moved to the next rest position 1334, the spring tension is released and the lock tab 1226 reengages the lock 1228, which in turn again secures the lid.

Figure 14:
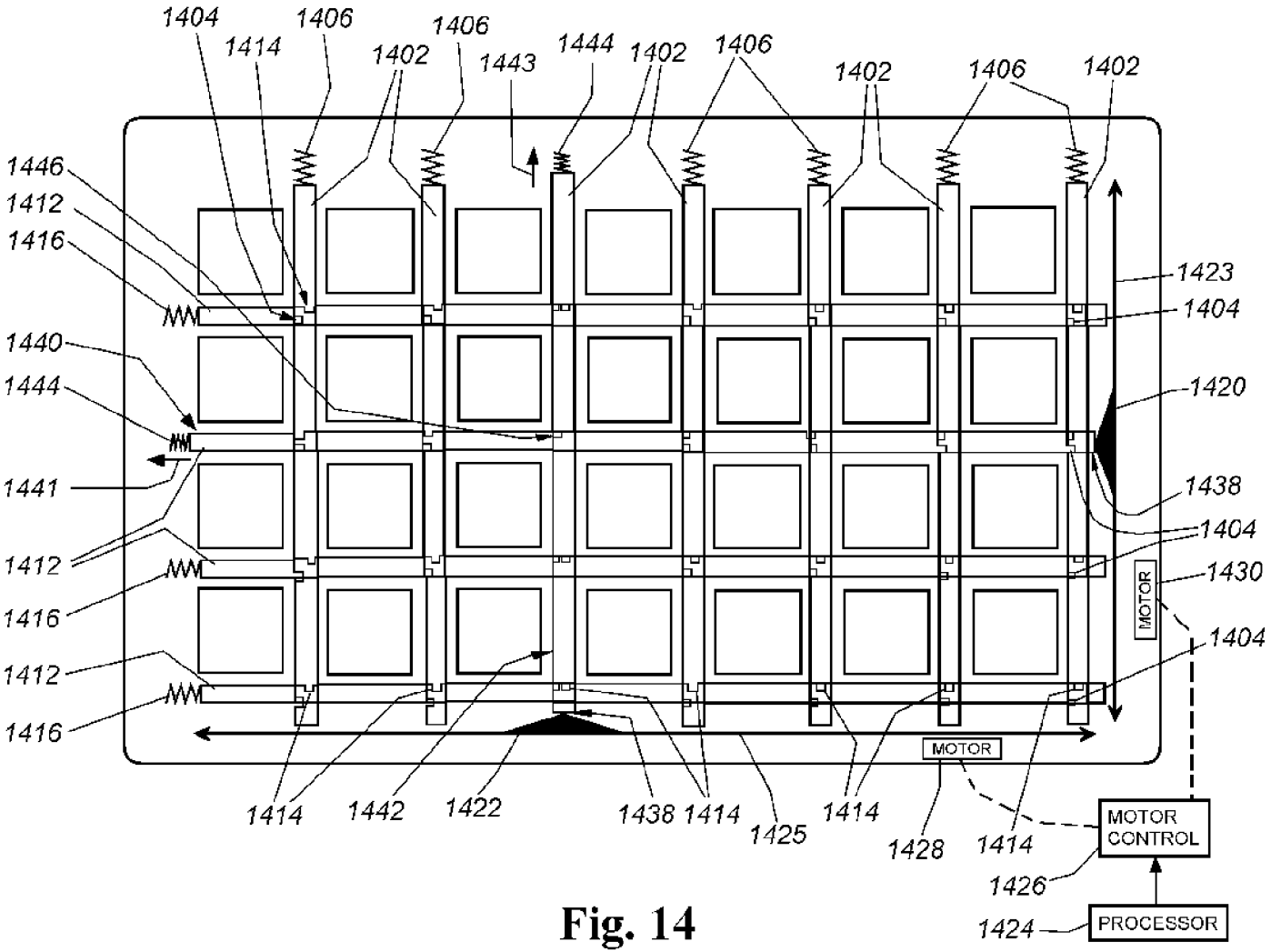
FIG. 14 is a view of a reloadable medication dispenser in which the latching mechanisms are operated by spring loaded bars according to an alternate embodiment.

FIG. 14 is a generalized embodiment of a so-called X-Y arrangement in which the lids of the pillbox are selectively unlocked by the interaction of overlapping spring-loaded bars or sliders. The vertical bars (or sliders) 1402 each have four notches 1404 that are sized to conform to the sizing of a latch mechanism (not shown). Each bar has a spring 1406 that in its relaxed state, urges the bar outwards so that the notches 1404 will block each latch mechanism and keep each compartment secure. The horizontal bars (or sliders) 1412 are each provided with seven notches 1414 that are identical in size to the vertical bar notches 1404. The horizontal bars 1412 each have a spring 1416 that functions in the same manner as the vertical bar springs 1406. As described further below, there are a variety of mechanisms that can be employed to selectively actuate each of the bars/sliders in each of the two orthogonal/rectilinear directions. This illustrative (and somewhat schematic) arrangement is operated by a set of motor-driven cam assemblies (termed simply "cams") 1420, 1422, which are moved linearly between each of the bar/slider ends to selectively actuate each bar/slider. The linear movement of each cam 1420 and 1422 is represented by respective double arrows 1423 and 1425. A variety of linear drive mechanisms can move this type of cam between positions along the housing. In an embodiment these arrows 1423 and 1425 can represent conventional, rotating screw drive assemblies (i.e. lead screws). Illustratively, each cam can include an internal thread that is threadingly mated to the external thread of a conventional screw-drive shaft. Each screw drive shaft extends along each of the vertical and horizontal directions, respectively. Thus rotation of each screw drive and are illustratively actuated by a processor 1424 that provides instructions to a motor control 1426 that, in turn, activates the motors 1428, 1430 that move the cams 1420 and 1422. The cams are moved (in a direction generally transverse to the direction of bar/slider movement) to positions along the side of the housing where they make contact with a particular bar (in an exemplary embodiment, bars 1440, 1442). The triangular shape of the cams provides a ramp along which an engaged bar end rides as the cam moves from a disengaged to an engaged position with respect to each bar end. At the apex 1438 of engagement, the cam causes the engaged bar(s) 1440, 1442 to fully retract (arrows 1441 and 1443), thereby causing their springs 1444 to compress to a desired distance such that their respective notches now align and create an opening 1446 that releases the designated latch and allows access to that particular dose via the now-operable lid. Note particularly that in the illustrative embodiment, the compartment containing the dose can only be accessed when a vertical bar 1402 is aligned with a horizontal bar 1412 and their respective notches align. When the preset time has expired, the cams 1420 and 1422 move away from contact, the respective bar springs relax and the opening 1446 disappears. This process is repeated for each of the latches within a given dosage cycle. It is expressly contemplated that rods can be substituted for the actuating bars.

Note, also, that the cams 1420, 1422 need not move sequentially from one adjacent compartment to another in the horizontal and/or vertical direction. Rather, the cams 1422, 1420 can move to any position along a respective column or row in the pillbox body/housing. Also, while the compartments and associated latches/lids are arranged in a rectilinear array of rows and columns, it is expressly contemplated that the compartments can have a variety of arrangements (including a trapezoidal, triangular, circular or other geometric arrangement), and the bars/sliders can be arranged in each of at least two directions to create an index point between two intersecting bars at each compartment, in which the appropriate movement of both bars at that index point can collectively allow opening/operation of the respective lid. In a circular arrangement, for example, bars can comprise concentric circles with crossing bars passing through a common center at various angles. Likewise, while the illustrative embodiment depicts four rows and seven columns, this is only illustrative of a wide range of row and column numbers (or other configurations) contemplated herein. For example in further embodiments, two rows can be provided. Likewise, columns can be arranged based upon weeks rather than days in various embodiments.

Figure 15:
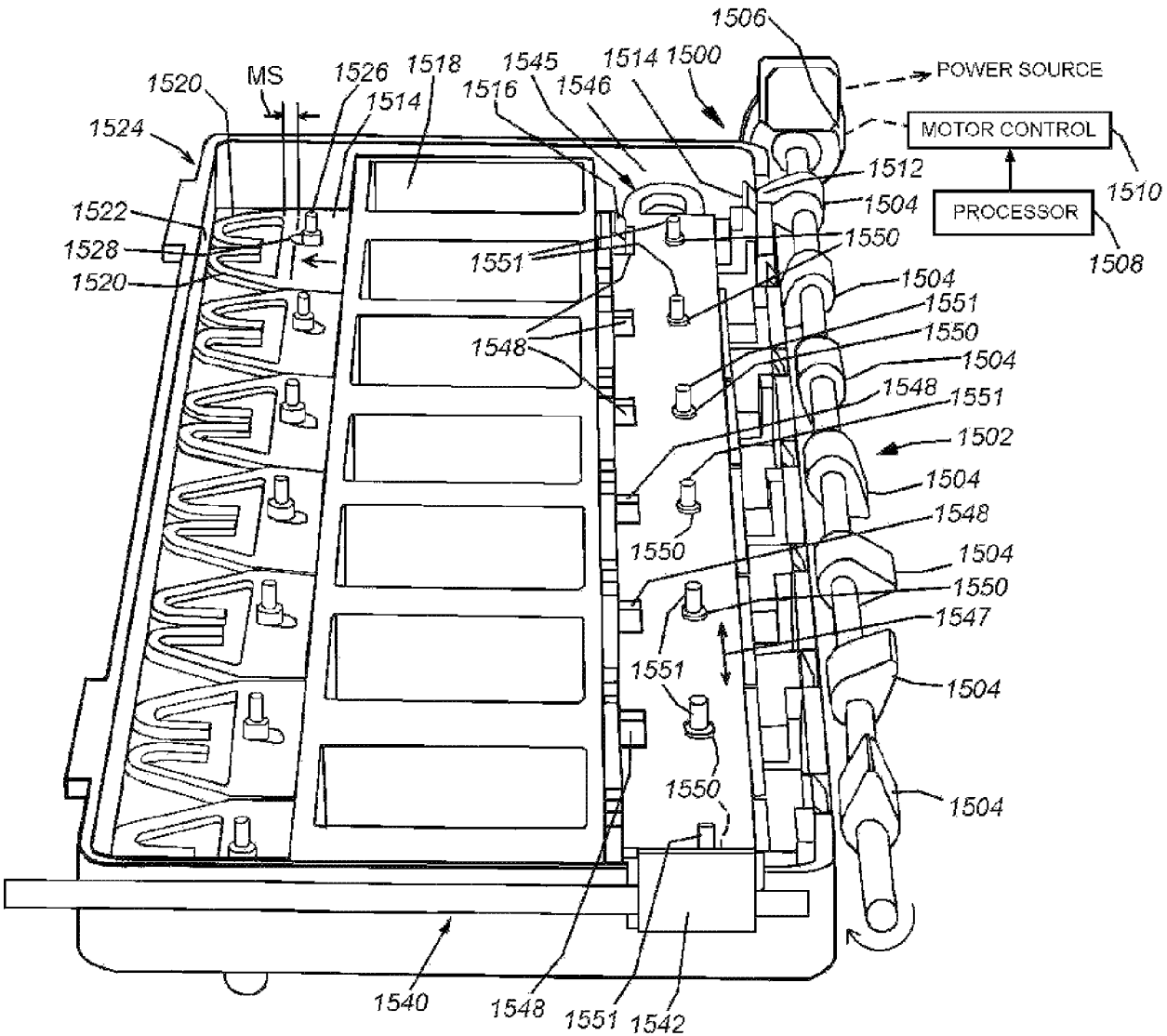
FIG. 15 is a view of a reloadable medication dispenser in which the latching mechanisms are operated by rotating cam shafts according to an alternate embodiment.

The above-described "X-Y" concept of using a cam assembly in which an eccentric lobe selectively engages the end of a bar or slider can illustratively employ a plurality of separate cam structures on, for example, a cam shaft that are each dedicated to engage a single bar/slider at a predetermined time. FIG. 15 shows a basic embodiment of a reloadable medication dispenser (shown herein as a single "Y-direction" column of seven compartments and lids for simplification) in which the lids and/or latching mechanisms are actuated by a rotating cam shaft according to an illustrative embodiment. The illustrative dispenser 1500 includes a camshaft 1502, seven lobes (or cams) 1504 and a gear motor 1506. The locking and/or latching system control operates as described above in FIG. 14 to selectively lock and unlock each lid based upon the alignment of a slot or other structure on each of a plurality of bars/sliders that are each adjacent to respective lids. The processor 1508 transmits a signal and/or power input to the motor control 1510 that actuates the unlocking mechanism. In this embodiment, that unlatching is accomplished by a camshaft 1502 that rotates one-seventh (or less) of a revolution, so that the radially eccentric tip (apex) of each cam lobe (for example, the first lobe 1512) engages (i.e. comes into contact with) an adjacent end of a slider 1514 and biases it rearwardly so that the latch 1516 is unlocked and the lid (not shown) is free to be opened, providing access to the relevant dose of medication. More generally, the camshaft is arranged so that a radially outward apex of each lobe is located at a discrete rotational orientation about a circumference of the shaft. In this manner, each time the camshaft rotates by that discrete arcuate distance, another lobe discretely engages and biases the end of a specific bar/slider associated with the lobe. The other bars/sliders along the row or column remain disengaged at this discrete rotational position. In an embodiment, the slider 1514 encloses the medication compartment 1518 and has two leaf springs 1520 that compress against the inner wall 1522 of the medication dispenser 1524. When the cam lobe 1512 contacts the slider 1514, it moves the slider a distance MS that is between approximately 1 and 5 millimeters. When the cam 1504 moves away from contact with the slider, the leaf springs 1520 uncompress and the slider returns to its rest condition, re-locking the latch mechanism and access to the medication compartment. A guide pin 1526 that engages a cut through guide slot 1528 maintains the proper orientation for the slider 1514. A second camshaft 1540 with a single cam 1542 is mounted perpendicular to the axis of the camshaft system 1500 and engages a slider 1544 that serves as a double lock on the latch 1516. The slider 1544 is furnished with an integral spring 1545 that engages an inner wall 1546 of the medication dispenser 1524 and compresses and uncompresses by operation of the camshaft 1540, causing the slider 1544 to move in a direction 1547. This allows cut-outs 1548 to engage an unengaged respective latch 1516. The slider 1542 has cut-out guide slots 1550 and guide studs 1551 that maintain the proper orientation. The camshaft 1540 has a gear motor (not shown) and is linked via a motor control or other circuit (not shown) to the processor 1508 so that its movements are synchronized with the camshaft system 1500 to properly unlatch medication compartments and re-latch those compartments so as to ensure a proper dosage of medications at the proper times. The camshafts system, bars/sliders and the tray components can be molded from a polymer (e.g. ABS plastic), or a similar polymer, metal and/or composite substance. Moreover, in any of the embodiments herein the housing can be molded or otherwise assembled to provide appropriate channels and/or other forms of guide ways so that bars/sliders can move freely in the linear/longitudinal direction (e.g., along the X or Y direction), but are free from lateral motion that can cause misalignment. The construction of such channels and/or guide ways in the housing should be clear to those of skill in the art.

Figure 15A:
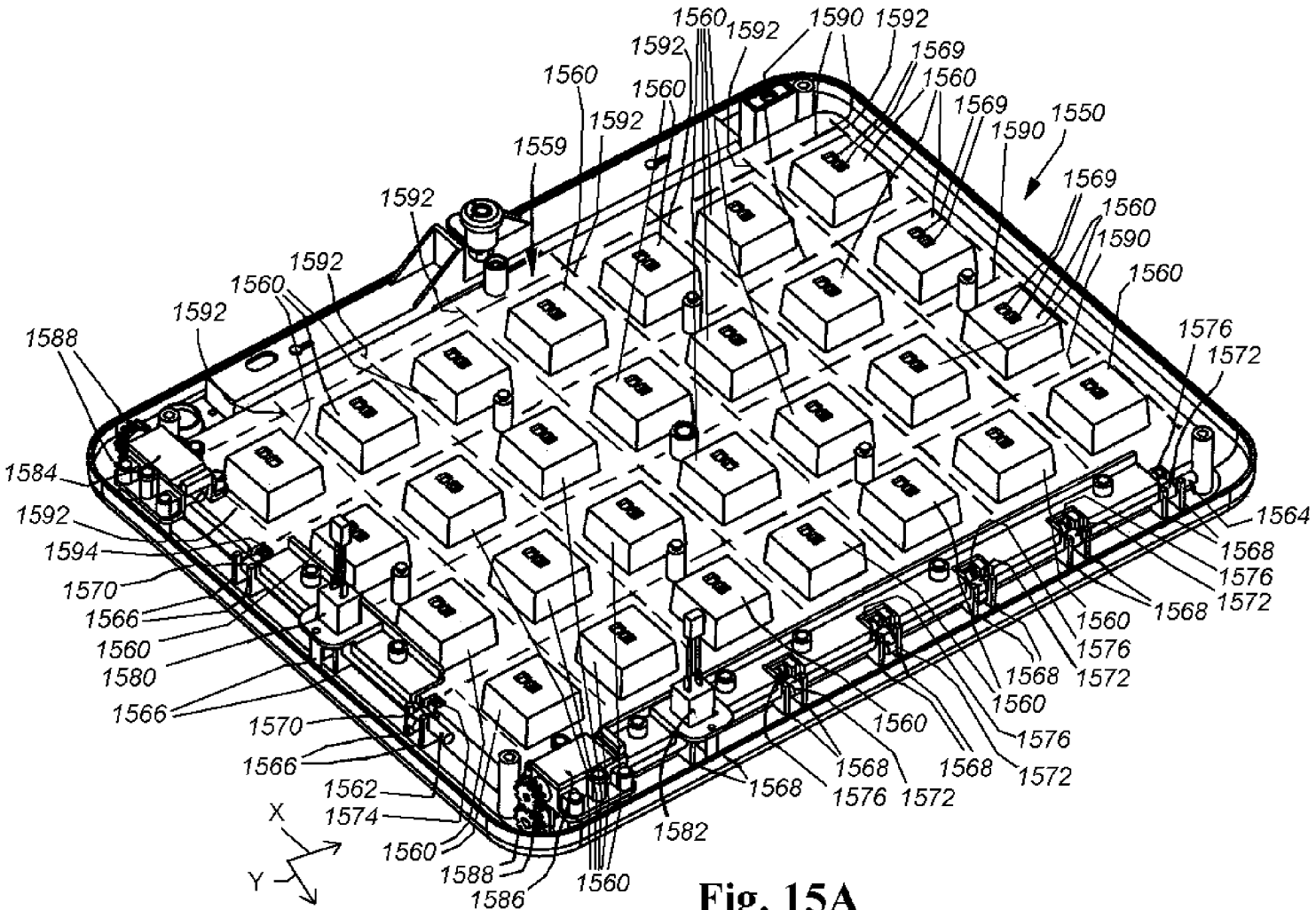
FIG. 15A is a bottom perspective view of the upper portion of a housing body for a medication dispensing system according to an illustrative embodiment, including compartments arranged in an orthogonal/rectilinear arrangement and a camshaft-driven locking/unlocking mechanism using crossing spring-loaded bars/sliders in an X-Y arrangement.
Figure 15C:
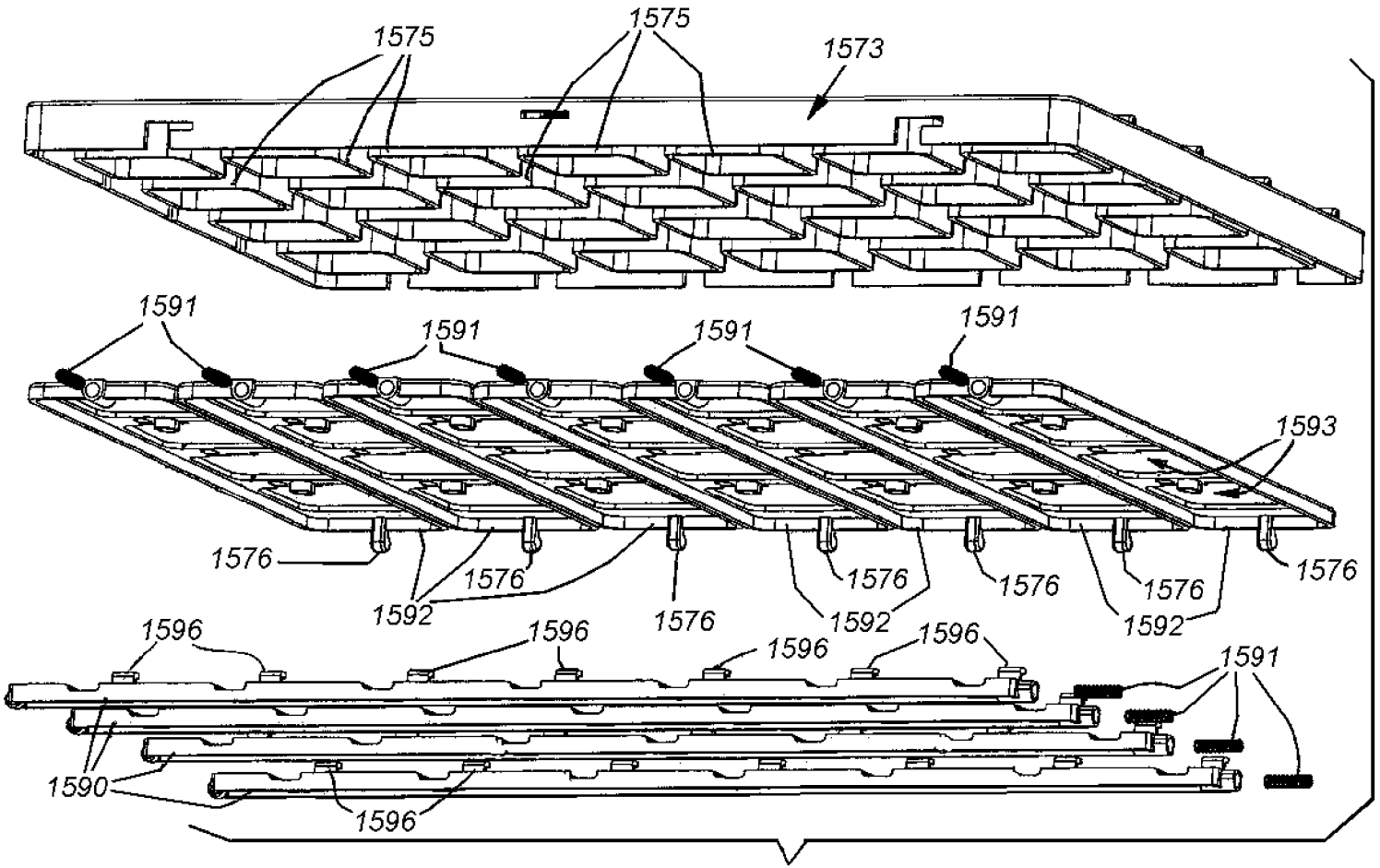
FIG. 15C is an exploded perspective view of the inner bezel assembly and associated bars/sliders of FIG. 15B.
Figure 15D:
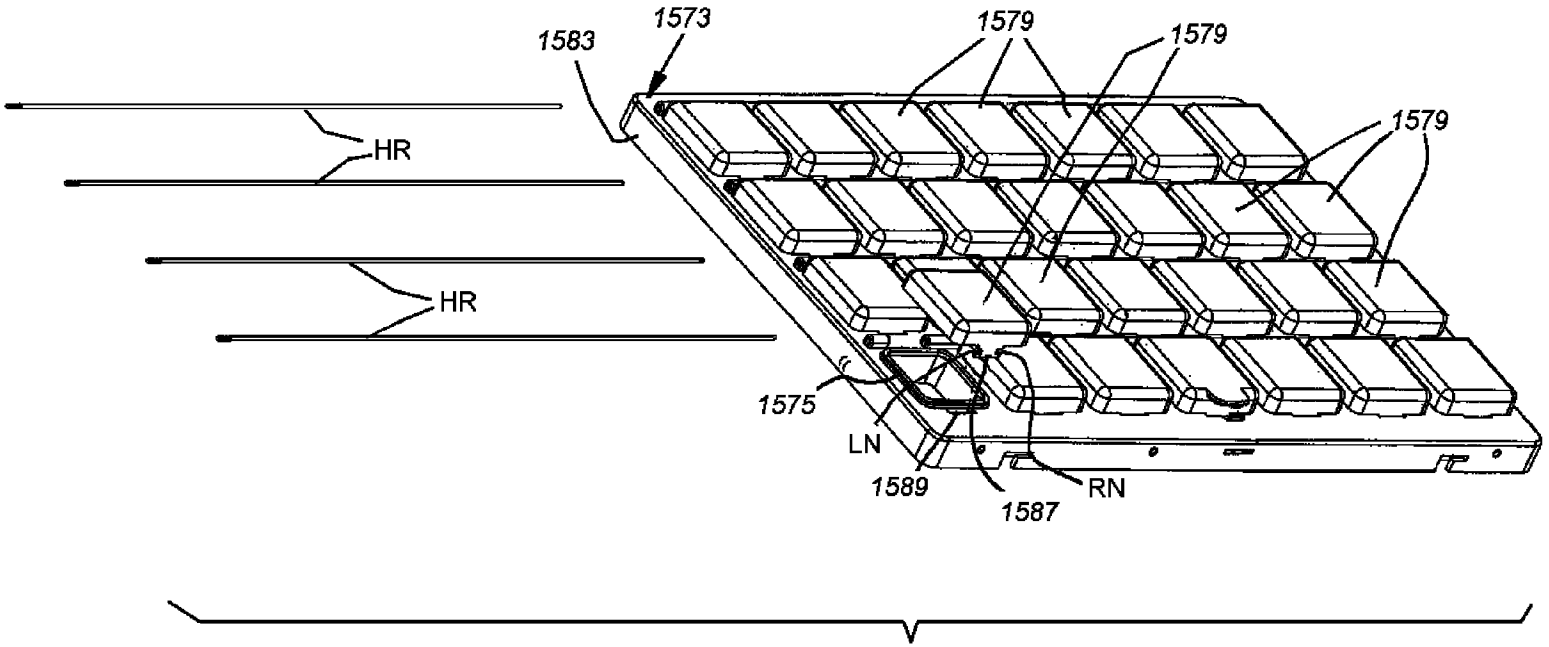
FIG. 15D is an exploded perspective view of the inner bezel assembly of FIG. 15C and associated lids.
Figure 15E:
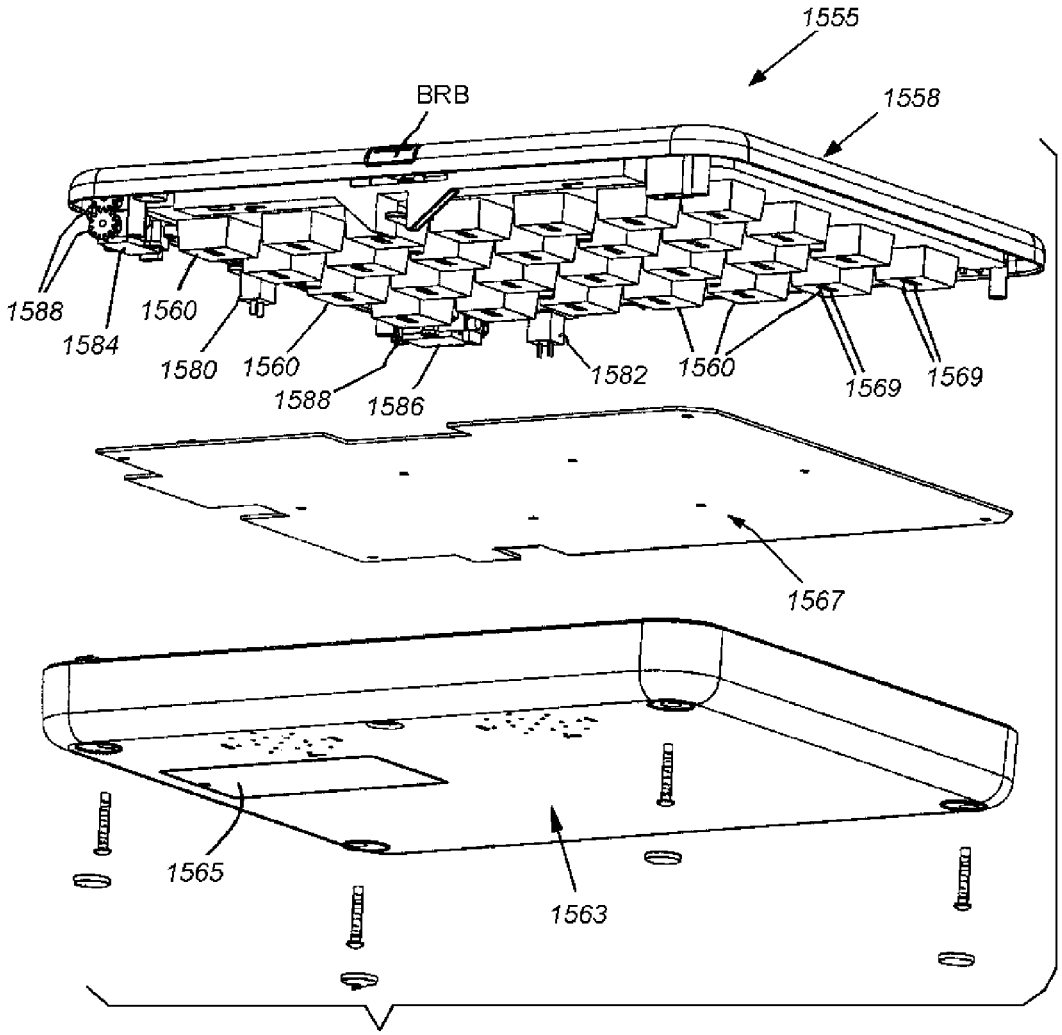
FIG. 15E is an exploded perspective view of the overall housing for the illustrative medication dispensing system, including the outer bezel assembly of FIG. 15A, a circuit board and a bottom housing base.

The use of a camshaft system in an X-Y configuration with crossing sets of bars/sliders and a rectilinear/orthogonal array of compartments and lids is shown, by way of an illustrative embodiment in FIGS. 15A-E, which variously depict the pillbox 1555 (FIG. 15E) and its various components according to an illustrative embodiment. FIG. 15A particularly depicts the bottom side of the upper portion (bezel) 1558 of the pillbox 1555. Particularly, FIG. 15B depicts the top side of the top portion/bezel 1558 with the compartment-carrying base 1589 omitted for clarity, but is shown in the overview of FIG. 15E as housing base 1563. This base 1563 includes a battery port 1565 and sandwiches a circuit board 1567 that can include various processors and controllers as described herein as well as cup sensors (e.g. micro switches) and indicator LEDs. These sensors and LEDs pass through ports 1569 in the bottom of each compartment 1560.

With reference also to FIG. 15C, the inner, lid carrying bezel 1573 is shown. It includes walled cut-outs 1575 from for the compartment wells (1560) The cut-outs guide (longitudinally) and restrain (laterally) the orthogonally arranged bars 1590 and sliders 1592 used to lock and unlock the various lids 1579 (FIG. 15D). Return springs (metal coil compression springs) 1591 are located in wells at the end of each bar/slider 1590, 1592, as shown in FIG. 15B. These springs 1591 bear against the inner bezel wall 1583. In this embodiment, the cut-outs 1575 and associated compartment wells 1560 are shown as an orthogonal/rectilinear array along the X and Y directions. Two separately driven camshafts 1562 and 1564 that respectively drive bars/sliders in each of the X and Y directions. The camshafts 1562 and 1564 are each supported by a plurality of respective brackets 1566 and 1568 that are molded into the upper portion 1558. In an embodiment, the brackets are provided in spaced-apart pairs that align and axially (longitudinally) restrain a respective lobe 1570, 1572 of the camshaft 1562, 1564. In this embodiment, the number of lobes 1570, 1572 (and number of sliders/bars) equates to the number of compartments along each direction. The lobes 1570, 1572 selectively contact respective slider ends 1574, 1576 as described above so as to selectively bias the associated bars/sliders against an opposing spring (described above).

In an embodiment, each camshaft 1562 and 1564 includes a lobe having an apex that engages a micro switch of other sensor 1580, 1582 at a predetermined rotational position. This provides a continuing alignment calibration signal to the controller for each drive motor 1584 and 1586. This micro switch (or other sensor) is operatively connected to the motor control circuit and provides a continuous reference form rotational position so that each camshaft is positively free of rotational drift over time. Another structure on the shaft can be used instead of a lobe to engage an appropriate alignment sensor.

As shown, each motor 1584, 1586 is operatively connected to an adjacent end of the respective camshaft 1562, 1564 by gears 1588 of appropriate size and ratio. The crossing bars/sliders are provided on the opposing top side (FIG. 15B) of the upper portion 1558, and are depicted as dashed lines 1590 and 1592 in FIG. 15A. As shown, the sliders 1592 each define a framework with central apertures 1593 of sufficient size to provided clearance for respective cups within compartments (1560) that underlie the apertures 1593. The size of each aperture 1593 is particularly sufficient to provide needed clearance in both a locked and unlocked position. The bars 1590 generally define elongated strips as shown that reside between compartments and cross the sliders 1592. The sliders 1592 and bars 1590 each include appropriate notches and/or other appropriate latching structures 1595 and 1596 that, when both biased by respective cam lobes, cause the associated compartment lid to unlock.

In this embodiment, and with further reference to FIG. 15D, the latching structures of the sliders 1592 comprise a small shoulder (1595) that normally resides on the right hand notch RN of each respective lid's locking tab 1587. This tab 1587 passes through a respective slot 1589 in the inner bezel 1573, where the tab normally engages the latching structures of the associated bar and slider. When the slider 1592 is moved in the Y direction to the unlocked position by action of the appropriate cam lobe, the shoulder 1595 is moved out of interfering engagement with the right notch RN of the tab 1587 on each lid in the associated column. Likewise, each of the latching structures on each of the bars 1590 comprises a raised L-shaped hook. The sliders 1592 provide a clearance for each hook 1596 in both the locked and unlocked position through a respective notch 1589 (FIG. 15B). The upper portion of the hook 1596 is coplanar and similar in thickness to the shoulders 1595 on the bars 1590. This upper portion normally engages the left hand notch LN on each respective lid's locking tab 1587. When a bar is moved in the X direction to the unlocked position under action of the cam lobe, the upper portion of the hook disengages from the left hand notch LN for each lid in the row. Only when both notches RN and LN are disengaged, is a lid fully unlocked. Based upon the timing of the camshaft lobes, only one lid at a time achieves this fully unlocked state. The processor and motor control circuitry "knows" knows the current state of the motor and can advance each camshaft as appropriate to unlock each lid at the appropriate pre-programmed time.

Note that the depicted lids are un-sprung. That is, the lids are individually lifted to an open position by hand when an indicator light (or other indicator) activates to illuminate the lid as described above, and that lid become fully unlocked. In further embodiments, the lids can be fitted with individual springs (e.g. metal coil springs or plastic leaf springs, so that, when unlocked, the lid pups partially or fully into an open position). In an embodiment, such popping hinges would open in a predetermined medication administration sequence only so as to avoid confusion motion, and a subsequent lid would pop only after medication from the previous open compartment had been taken (i.e. the cup therein had been removed). In various embodiments, a common hinge rod HR FIG. 15D can pass through each hinge in a row to provide a hinge pivot.

It should be clear that a wide range of latching and/or locking structures can be employed in various embodiments, and in accordance with ordinary skill. In the example of FIGS. 15A and 15B, the compartment 1597 has been unlocked due to the engaged position of its respective lobes 1598 and 1599 (See FIG. 15B). Note also that (like the framework sliders 1592) the extending portions of the bars/sliders along either direction (X or Y) can be offset to the side relative to the ends that engage lobes. This can be desirable to ease the construction of the pillbox and allow for the best fit and interaction of its components. More generally, the bars/sliders can be formed in a variety of shapes that accommodate the construction of the pillbox.

Illustratively, the apex of each lobe on at least one of the camshafts is located circumferentially so that a neutral position exists between at least two lobes sufficient to allow all sliders to remain locked. In a resting state, one or both camshafts can reside rotationally in this position based upon the control of the motor control circuit and/or processor. While a pair of geared motors are employed herein, one for each camshaft, it is expressly contemplated that a geared transmission can be used in conjunction with a single drive motor to achieve a desired pattern of locking and unlocking of successive lids. For example, the transmission can cause the column bar/slider to unlock and then successively unlock each row. This can also be achieved with a column-actuating camshaft that has an extended apex so that a given column remains unlocked (as the column camshaft slowly rotates) while the row-actuating camshaft rotates to selectively open a succession of rows. In other words, the column actuating and row-actuating camshafts are driven at predetermined rotational speeds by a common motor and transmission. The lobes on the column-actuating camshaft are each timed to maintain a given column in an open position while the lobes on the row-actuating camshaft move from one row to the next. Illustratively, the motors employed to drive one or both camshafts can be any acceptable type of motor capable of operating with relative rotational precision. In an embodiment, the motors can be a stepper or servo-type that rotate a predetermined rotational distance under control of the processor and/or motor controller.

It is expressly contemplated that any and/or all the various optional features, such as alert, messaging, communication and media display can be employed in according to the embodiment of FIGS. 15A-E. Likewise, it is expressly contemplated that the outer bezel 1558 can be opened (e.g. via bezel release button BRB in FIG. 15E) to reveal the inner bezel 1573, and allow insertion and/or replacement of an appropriate refill/refillable tray of cups containing predetermined doses of one or more medication (e.g. pills, capsules, etc.) for administration at a pre-programmed time within the overall medication schedule established for the user by interested parties.

Note also that while the camshaft(s) used herein are constructed so that a radially outwardly eccentric lobe (apex) causes unlocking of a lid, it is expressly contemplated that a camshaft can be constructed so that unlocking occurs when a radially inward depression is encountered by a bar or slider end. That is, the camshaft lobe normally biases the each bar/slider into a spring-compressed orientation that causes locking of the associated lid(s). When the depression on a lobe faces the associated bar/slider end, then the spring biases that bar/slider into the unlocked position.

IV. Additional Features

Commercially available communication systems encourage independent living and are provided as a subscription service. Compact communications systems provide for two-way communication between the user and a remote operator. These systems can be linked to a medical alert system provider or another third party via a communication network that provides for activation by a consumer when a medical crisis arises and that transmit a signal to a provider that assistance is requested. A conventional communication system includes a wireless actuator device, a transceiver and a remote operator service. The consumer of the illustrative pillbox can also benefit from an integral communication system, resulting in a situation in which there are two tandem telecommunication systems in the household, one for the communication device and the other for the pillbox. Given that the pillbox has an integral transceiver and is in telecommunication with remote systems, a communication actuator and/or communicator can be built into the pillbox. The pillbox's communication system is constructed and arranged to route signals from the communication system via the pillbox's onboard transceiver for passing on communications to the service representative for the communication system provider. The pillbox can provide a wireless link for actuation by a remote device.

Figure 16:
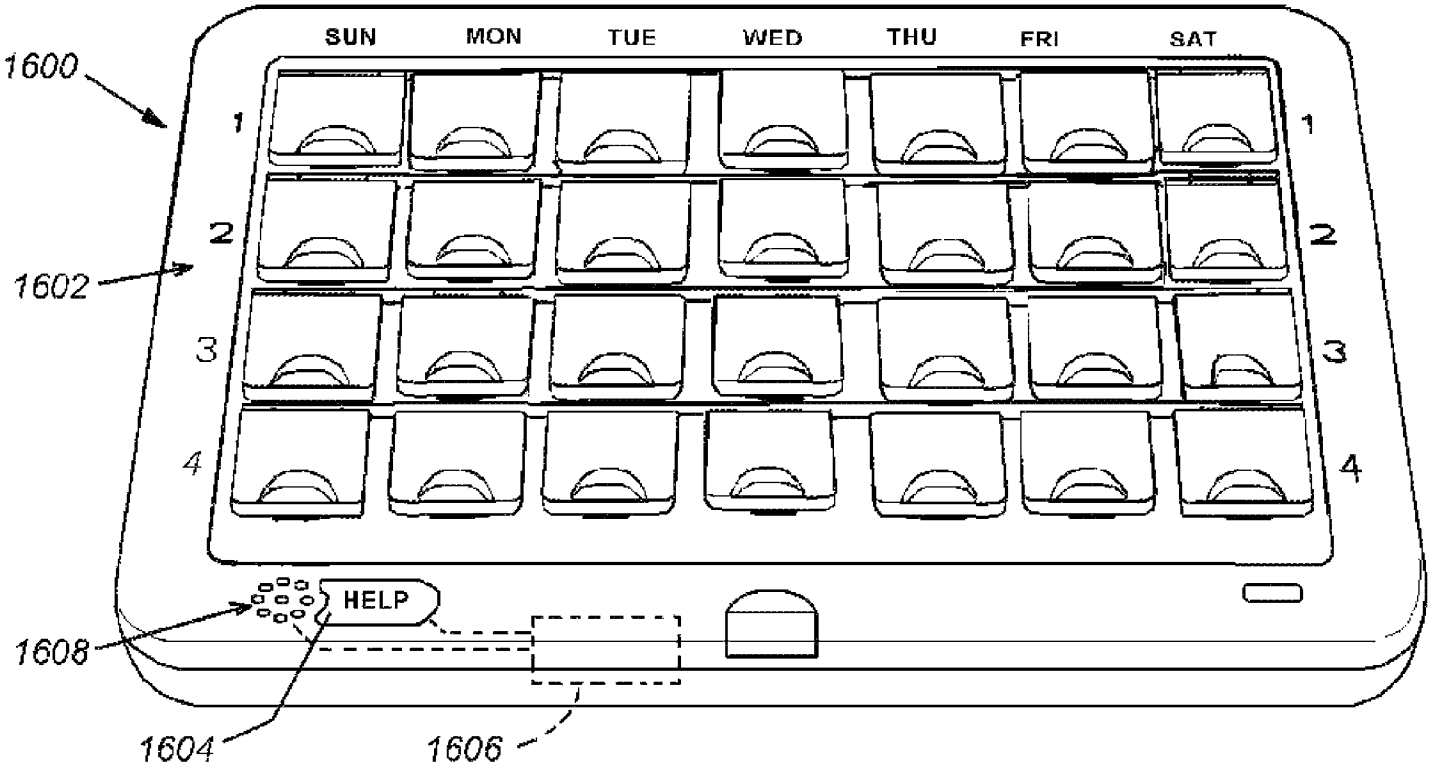
FIG. 16 depicts a communication system built into an illustrative pillbox.

FIG. 16 shows an illustrative embodiment of a pillbox 1600 that, in addition to the locking features and/or other features described above, is also provided with an internal communication device. The bezel door cover 1602 has an actuator button 1604 that communicates to the remote communication system operator (not shown) through a communication link to the pillbox transceiver 1606. The combination microphone/speaker 1608 integrated with the pillbox facilitates spoken communication with the remote operator. It is expressly contemplated that the alert device can be supplemented with a personally worn actuator that wirelessly communicates through the transceiver 1606. In alternate embodiments, the microphone/speaker can (also or alternatively) be built directly into the sides of bottom of the pillbox body. The subscription service costs for the alert system and the pillbox can be combined into a single billing for the convenience of the consumer. The actuator button 1604 can be red in color or another color and can be provided with Braille lettering for the visually impaired. In a further embodiment, all interactive buttons, surfaces, doors and lids can be provided with Braille lettering. The microphone/speaker, when combined with a small, board-mount camera (e.g. in the form of a webcam) can provide two-way audio and/or visual communication between the alert subscriber office and the user that can assess the nature of the emergency and the urgency of the situation. At least one of a microphone and a camera on the body for communication by a user with a remote party through a network. The two-way communication can also be used to link the user's next-of-kin (or other designated person) with the user to keep the user calm while emergency technicians are summoned, as well as alerting them to the overall emergency.

As set forth above, it is contemplated that the interactive medication dispensing system can provide audible, visual and other forms of alerts. In an alternate embodiment, the alert can be provided as a pre-recorded personalized audible and/or visual reminder. The reminder can be recorded by a significant friend and/or relative (for example, an old service buddy or a granddaughter). When the time for the alert is given the prompting reminder to take the dose is in a friendly (or otherwise familiar) voice. This alert can be in the form of a cute little grand-daughter telling the user, "Grandpa, time to take your pills." In addition, the return of the medication cup to the dispensing system can then prompt a gratification message, for example, the same little grand-daughter now saying, "Thank you for taking your medicine, Grandpa, I love you!" Messages of this form can be particularly useful in the case of users that are suffering some form of memory or cognitive impairment.

It is further contemplated that recordable messages can be provided to the pillbox through the server or a third-party based communications device. The recorded messages can include reminders of medical or other appointments, scheduled events, the date (for example, "Grandpa, it's Monday"), or important dates in the user's life (for example, "Happy Birthday", "Lunch Time", "time for bed", etc.). It is expressly contemplated that the recordable messages can include promotional messages from interested third-party providers (for example, "the pharmacy has a 20% off sale today" or "men's slacks are half off today"). The pillbox can be provided with a preset or user-preferenced (e.g. via the remote GUI) filter for content or preferences in third-party providers.

Figure 17:
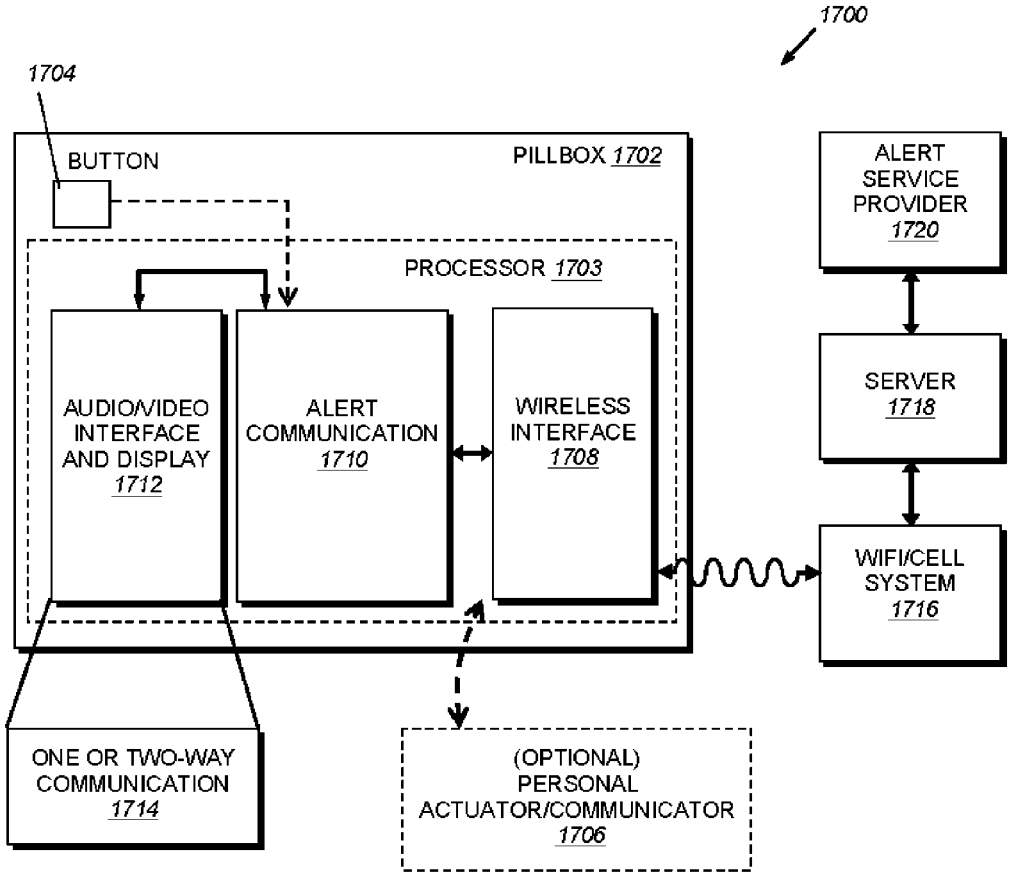
FIG. 17 depicts is a block diagram of an illustrative communication arrangement and associated process for sending an alert to a service provider utilizing the communication system and receiving feedback therefrom.

FIG. 17 is a schematic view of the process for summoning help using the communication system as set forth in FIG. 16 above. The user-generated alerts within illustrative communication system 1700 are received by the processor 1703, located in the pillbox 1702. The alert is triggered by the user, personal caregiver or another person. The alert is transmitted by the button 1704 or the optional personal actuator and/or communicator 1706 (e.g., a wrist band or key fob). The alert triggers the alert communication application 1710. This application 1710 allows one-way or two-way communication 1714 via the audio/media interface and display 1712 of the processor 1713. In this manner, a service provider (for example, a medical alert provider that monitors for patient communications via a wearable device, etc.) can carry out a post-alert communication with the user if appropriate to ascertain the user's health status and condition. The pillbox 1712 has a wireless receiver that can be tuned to receive alerts using frequencies common to communication devices. Once the processor 1713 has received the alert, the alert signal is transmitted wirelessly by the pillbox 1712 to a WIFI/cellular telephone system 1716 and relayed to the server 1718. The alert is then sent to the alert service provider 1720 for action. Alternatively, the pillbox can place a direct call to the alert service provider via telephone or the internet. Two-way communications can be achieved between the alert service and the user, either via the internet or telephone. The pillbox can also be provided with a short-range wireless communications device (for example, Bluetooth or equivalent technology). It is expressly contemplated that if a medical provider is viewing the user via a camera and witnesses a potentially dangerous situation, that the provider can initiate the communications system alert if the user is unable to do so.

Figure 18:
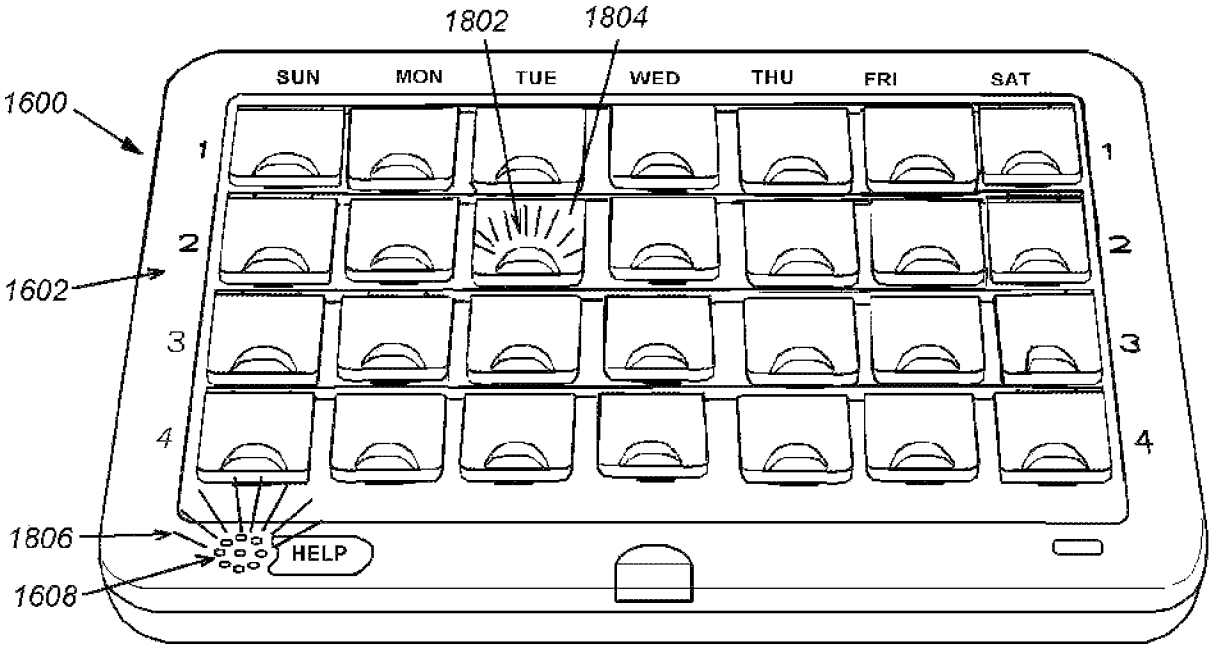
FIG. 18 depicts a pre-recorded alert message in process while an illuminated alert is issued.

FIG. 18 shows an example of a personalized alert being delivered during runtime operation of the pillbox. The medication dispensing system 1600 of FIG. 16 has been provided with the microphone/speaker 1608 and includes a stored, pre-recorded and personalized message. When the alert begins, the particular dose 1802 is indicated by illumination, as set forth above, and the door 1804 will be unlocked. At the same time, the prerecorded message 1806 is emitted from the microphone/speaker 1608. When the dosage cup (not shown) has been returned, a gratification message is emitted from the microphone/speaker 1608.

The alert and gratification follow-up messages can be recorded by either recording the message into the microphone/speaker 1608 or by using the server. This can be facilitated by a telephonic link into the server or by accessing a recording function in the server by way of a local computer having a microphone. This allows for a grandchild or other significant friend or relative to log into the server from a home computer, record alert and gratification messages that are then either transmitted to the medication dispensing system at each alert time via the server's communication link, or that are transmitted once, and stored internally within the digital memory of the medication dispensing system using conventional sound file storage techniques (e.g. a .wav or .mpeg file). This provides as well for a remote updating function for revising messages or substituting the significant friend or relative. In an alternate embodiment, the voice message (for example, the above-described gratification, reminder and alert messages) can be accomplished via a text message and a speech-producing software application that converts the text message into the spoken word. This application can be provided in the server or in the personal communications device. Conversely, an application can be provided to convert the user's spoken word into a text or written message for transmission by commercially-available messaging protocols. These text to spoken word and spoken word to text applications can be provided from commercial sources and integrated with the operating system of the pillbox and/or server and include, but are not limited to, SMS (Short Message Service)-based protocols.

In an embodiment, the medication dispensing system is provided with a visual display, as will be set forth more fully below, it is contemplated that the alert and gratification (follow-up) messages can be visually recorded using a webcam, cellular phone, or similar device on a remote client device or directory on the system. Once recorded, this message then appears on the visual display of the medication dispensing system and serves to reinforce the illuminated dosage alert.

Figure 19:
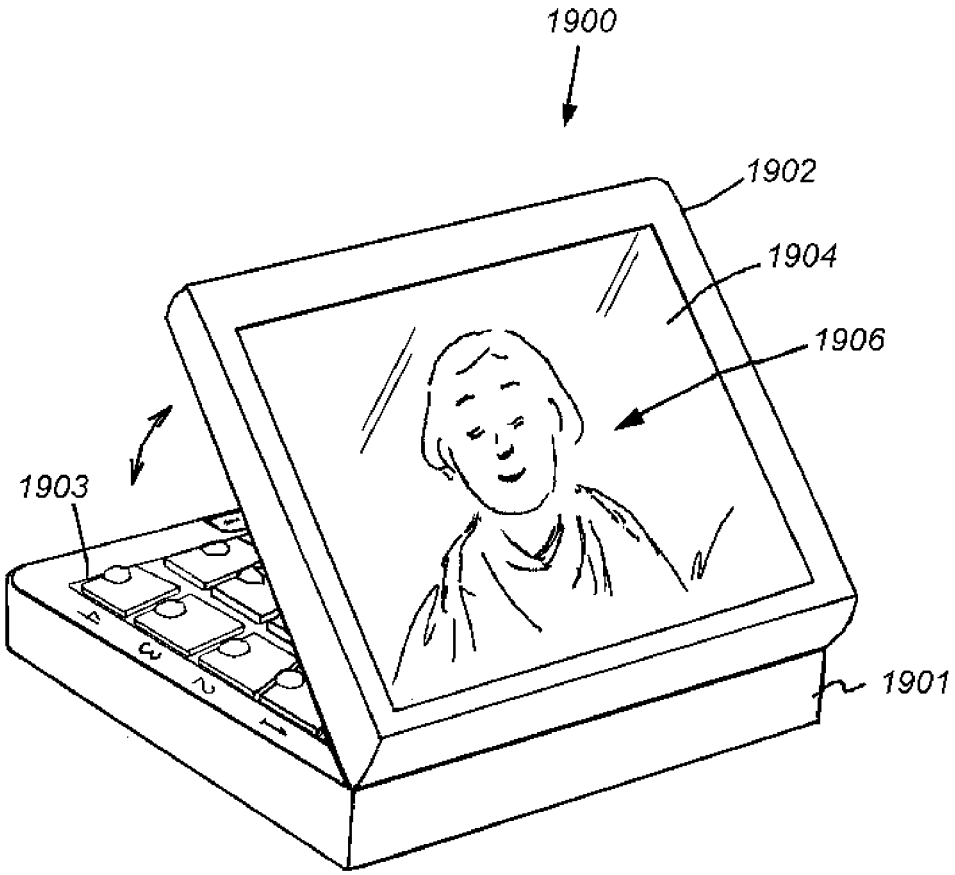
FIG. 19 depicts a pillbox with a visual display incorporated into a lid according to an illustrative embodiment.
Figure 20:
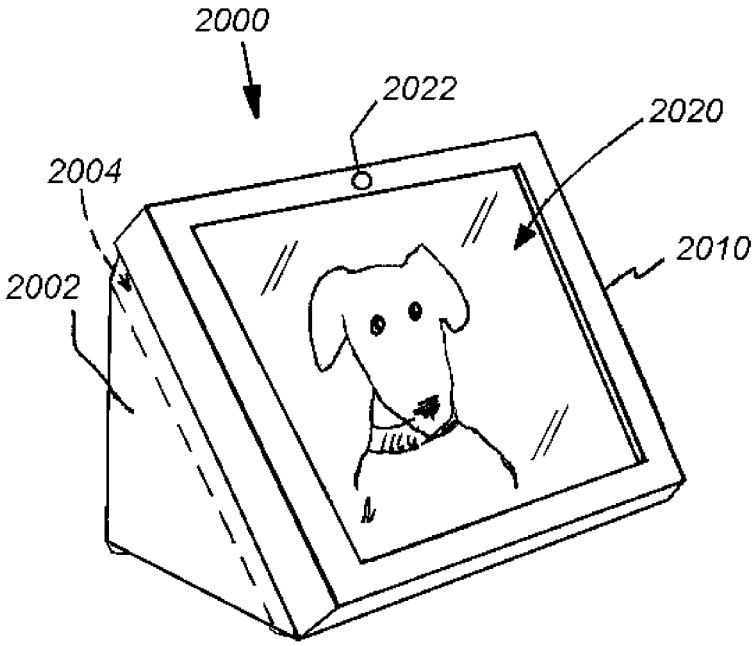
FIG. 20 depicts a pillbox that is mounted at an angle and has a cover that has a built-in visual display according to an illustrative embodiment.
Figure 21:
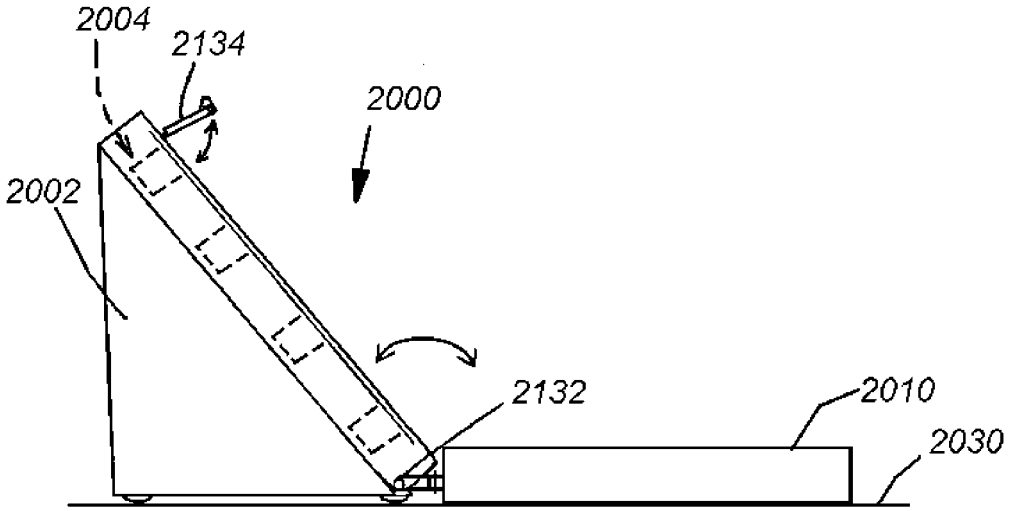
FIG. 21 depicts the pillbox of FIG. 20 with the cover opened for access to the medication cups in an illustrative embodiment.

The miniaturization of visual displays utilizing liquid crystal display (LCD) and similar technologies provides that the medication dispensing system can have a fold-out visual display or a visual display that is mounted onto and/or into one or more of the surfaces of its body for the display of images. FIGS. 19, 20 and 21 depict embodiments that, in addition to the locking and/or other features described above, include a visual display that is included in the various surfaces of the medical dispensing system body. The media display device is movably mounted on the body so as to move between a display position and a cup-accessing position.

FIG. 19 shows a medication dispenser system 1900 having a body 1901 as described above, with an openable/closeable cover 1902 and a refillable tray 1903. The cover 1902 has a visual display 1904 that can function when the lid is closed or raised. The media display device is constructed and arranged to play at least one of a recorded (a) media reminder message based upon a time in the preprogrammed schedule in which medication is due to be administered and (b) media follow-up message based upon accessing of a predetermined of the cups to obtain a medication to be administered in accordance with the pre-programmed schedule. The screen can be used to display a single image 1906 or to stream a series of images. The image can be interrupted at the alert time to visually display a reminder. In another embodiment, the screen 1904 can be interfaced with a media source and used to stream media output, such as streaming web program, or a digital interface utilizing a touch screen, as will be more fully set forth below. In a further alternate embodiment, the display can present active visual alerts for hearing impaired users (for example, displaying the words "TIME TO TAKE YOUR MEDS") prominently across the screen in a fixed, streaming, flashing, or other motif. In another embodiment, the visual display can be sited on the inside of a cover on the medication dispenser system. This provides a multi-sensory alert system that combines a variety of sensory stimulations for reinforcement of the prescription medication therapy. One advantage of the media screen is that it can be used to selectively cover the pillbox and provide an aesthetically pleasing view to the user. For example, it can display a wallpaper or series of pleasing images in the manner of a screensaver. Conventional hardware and software can be used to drive this display function.

Note that the audio and/or visual playback devices described herein can be driven by conventional driver circuits integrated with the onboard microprocessor (not shown). Such circuits can be implemented in whole, or in part (like other functions described herein) using electronic hardware, software including a non-transitory computer-readable medium of program instructions, or a combination of hardware and software.

FIGS. 20 and 21 depict an embodiment in which the medication dispensing system 2000 is provided with an openable/closeable cover 2010 and is placed in a mount 2002 that places the medication tray 2004 at an angle relative to a table top. This angled arrangement allows the medication dispenser system to appear less medical and more of a design feature within the user's personal environment. FIG. 20 shows the medication dispenser system 2000 in a closed configuration. The cover 2010 has a screen that can be used to display a single image 2020, stream a series of images or serve as a digital and/or media interface. The medication dispenser system 2000 is presented herein with a web camera 2022 that can provide two-way visual communication with the service provider. As stated above, the camera can be used as a continuous feed, a clip at the time of medication administration, for sending an alert, status report, response to a questionnaire or other communication need. The display can be a single image, a stream of images or a combination of both. The images can be keyed to the alert time to show more insistent images, or to visually evolve and/or morph into an insistent alert image, followed by a happy gratification image or short image clip. These images can also be animated images and be accompanied by a music clip. The choice of images can be provided by the user for greater personalization, or from a package of images provider by the service provider. The variety of display images and programmed audio visual messages has been developed for compact electronic devices, for example, a laptop computer, represents a plurality of affordable lightweight display options. It is contemplated herein that as these display images become faster and more agile, that the available display options will become greater and more complicated. For example, a flexible display, which can be rolled or folded, can be employed in illustrative embodiments.

FIG. 21 is a side view of the medication dispenser system 2000 in an open configuration with the cover 2010 resting on a level surface 2030. The cover 2010 is secured to the mount 2002 by hinges 2032. In an alternate embodiment, the cover 2010 can be opened partially. The open cover 2010 allows access to the medication tray 2004 and each door 2034.

As set forth above, a visual display can be an interactive digital display that utilizes a touch screen mounted on the medication dispenser system. The interactive display allows a user to interact with the server, request information, report on status, receive reminders of medical appointments, and similar information. For example, a user can use the touch screen to call up the medication schedule, inquire about drug interactions or side effects. The visual display can have a generic interface screen when engaged by a touch and a screen saver image when not engaged.

Figure 22:
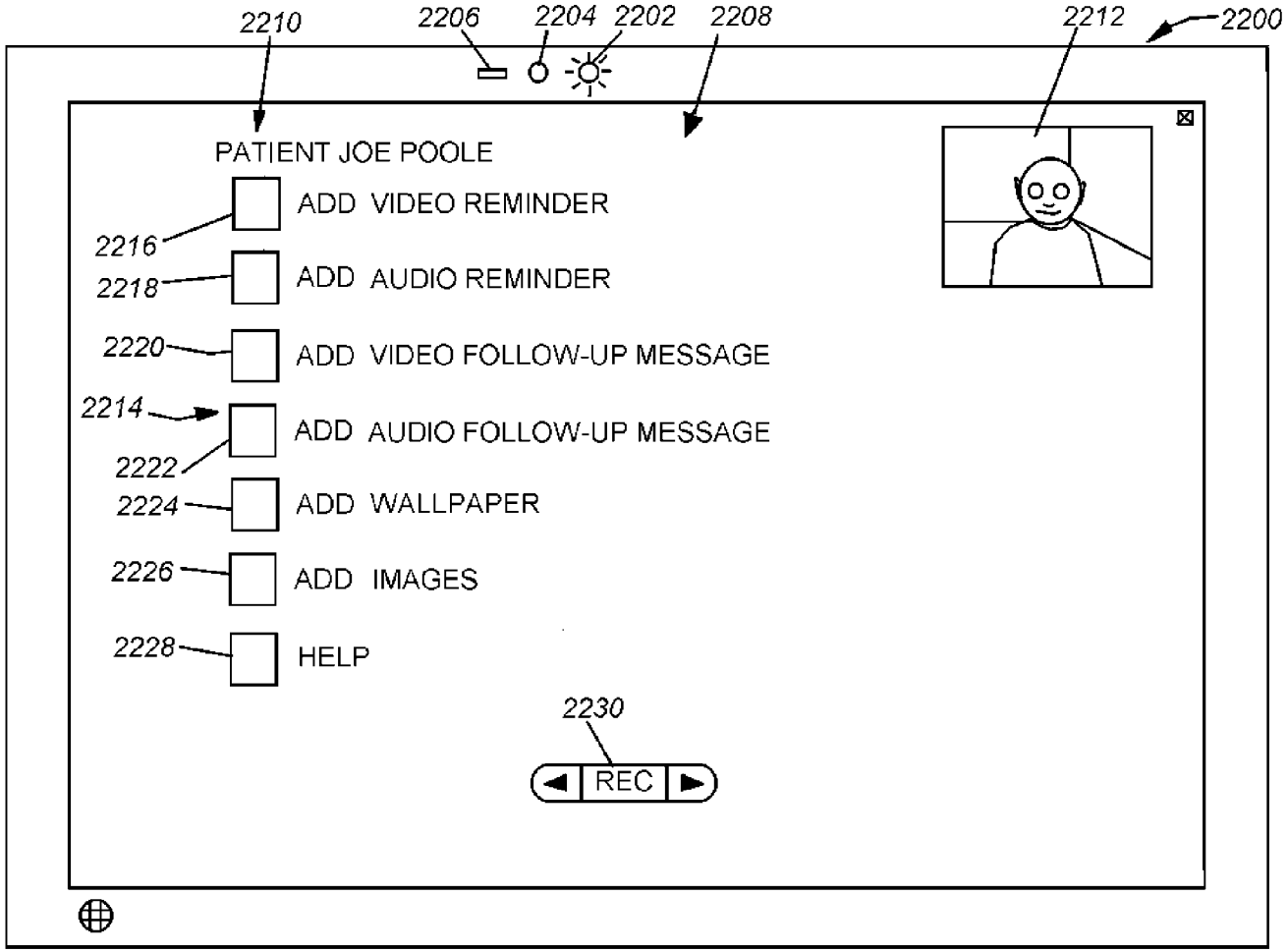
FIG. 22 depicts a graphical user interface (GUI) for personalizing audio and visual effects in connection with the display panel according to an illustrative embodiment.

FIG. 22 shows an illustrative graphical user interface (GUI) associated with the display of a client computer in communication with the server that allows the user or care giver to personalize audio/visual effects in connection with the display panel. A visual display 2200 is provided with an illumination source 2202, camera 2204 and microphone/speaker 2206. The graphical user interface (GUI) screen 2208 is opened on a user's or caregiver's local client computing device and is connected via a web-based or other telecommunication link to the server for relay to the pillbox. The user/caregiver is operating a standard web browser application that supports the graphic user interface. The user is identified 2210 and a screen image 2212 of the user as seen by the camera 2204 is presented at the top for framing purposes when the web camera is in use. The screen options include a plurality of selection icons presented as buttons 2214 that can be activated digitally, with a hand-operated electronic device that controls the coordinates of a cursor or other selector device. At least one of the reminder message and the follow-up message is recorded through the server by a client device and is stored on a memory operatively connected to the processor. The buttons 2214 include a selector for adding a media reminder 2216 or audio reminder 2218 that create the alert message that is emitted at the time for medication administration. Buttons for the media follow-up message 2220 and audio follow-up message 2222 that present the post-administration gratification (follow-up) message.

Additional selections provide for adding or substituting the display wallpaper 2224, adding or substituting images 2226 and a help button 2228. A recording interface 2230 is included in the graphic user interface screen 2208.

Figure 23:
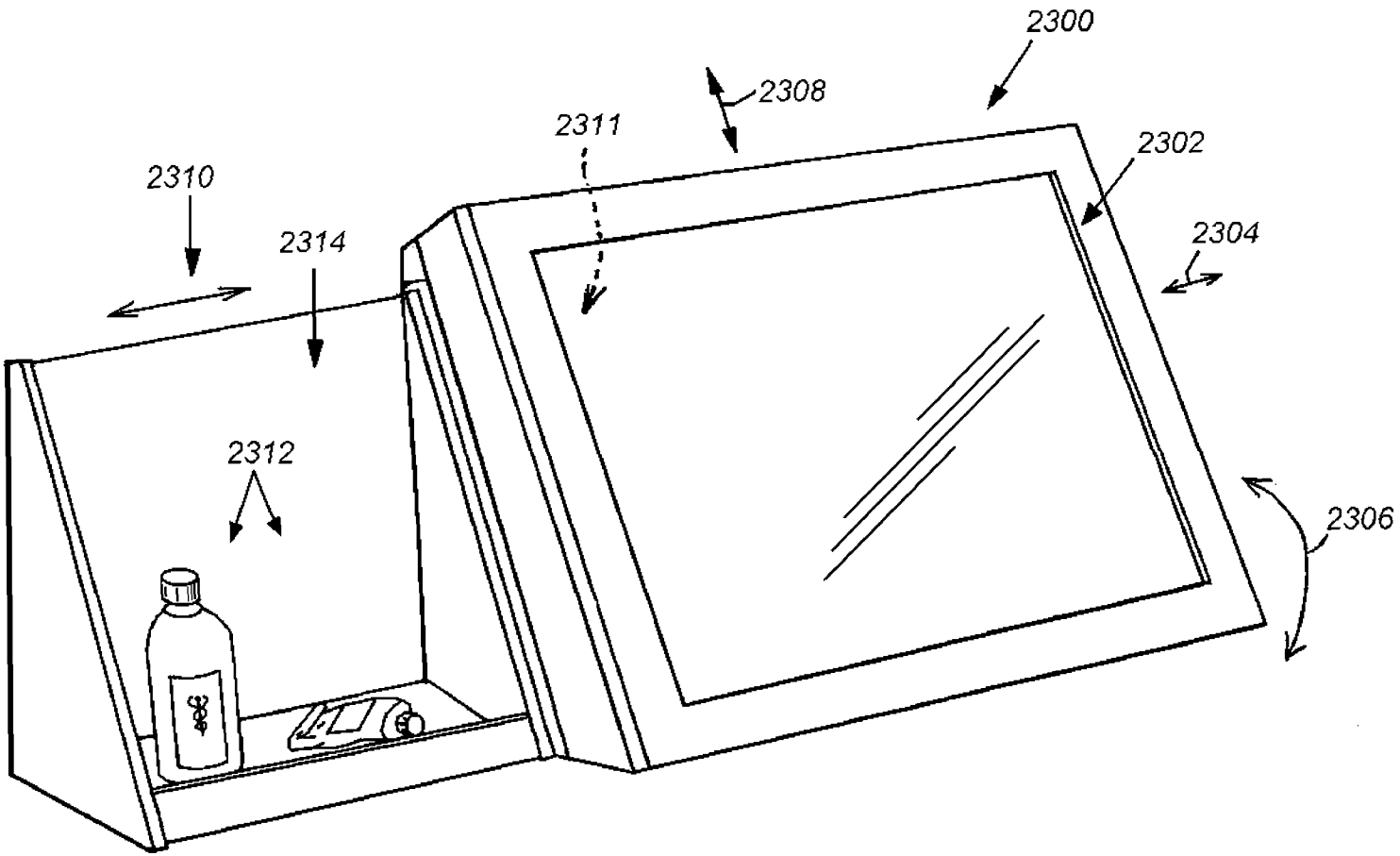
FIG. 23 depicts a pillbox having a display panel and a side-opening drawer according to an illustrative embodiment.

A pillbox 2300 having a display panel 2302 and a side-opening drawer assembly 2310 is shown in FIG. 23 according to an alternate embodiment. The display panel 2302 can be constructed so as to move laterally 2304, opened forward 2306 on a hinge assembly or raised 2308 to provide access to the contents 2312 of the inner compartment 2314 or to a layer of medication compartments 2311 as set forth above. The drawer 2310 can be opened on a side and manually operated, electrically driven or spring-loaded. This system provides storage of medication containers containing larger doses of liquids, ointments or other therapies. The operation of this pillbox can be scheduled, as set forth above, and provided with sensors (not shown) to monitor the completion of removing the medication container and replacing the medication container. It is expressly contemplated that this pillbox can be provided with a built-in refrigeration device for temperature control when temperature-sensitive medications are involved.

Figure 24:
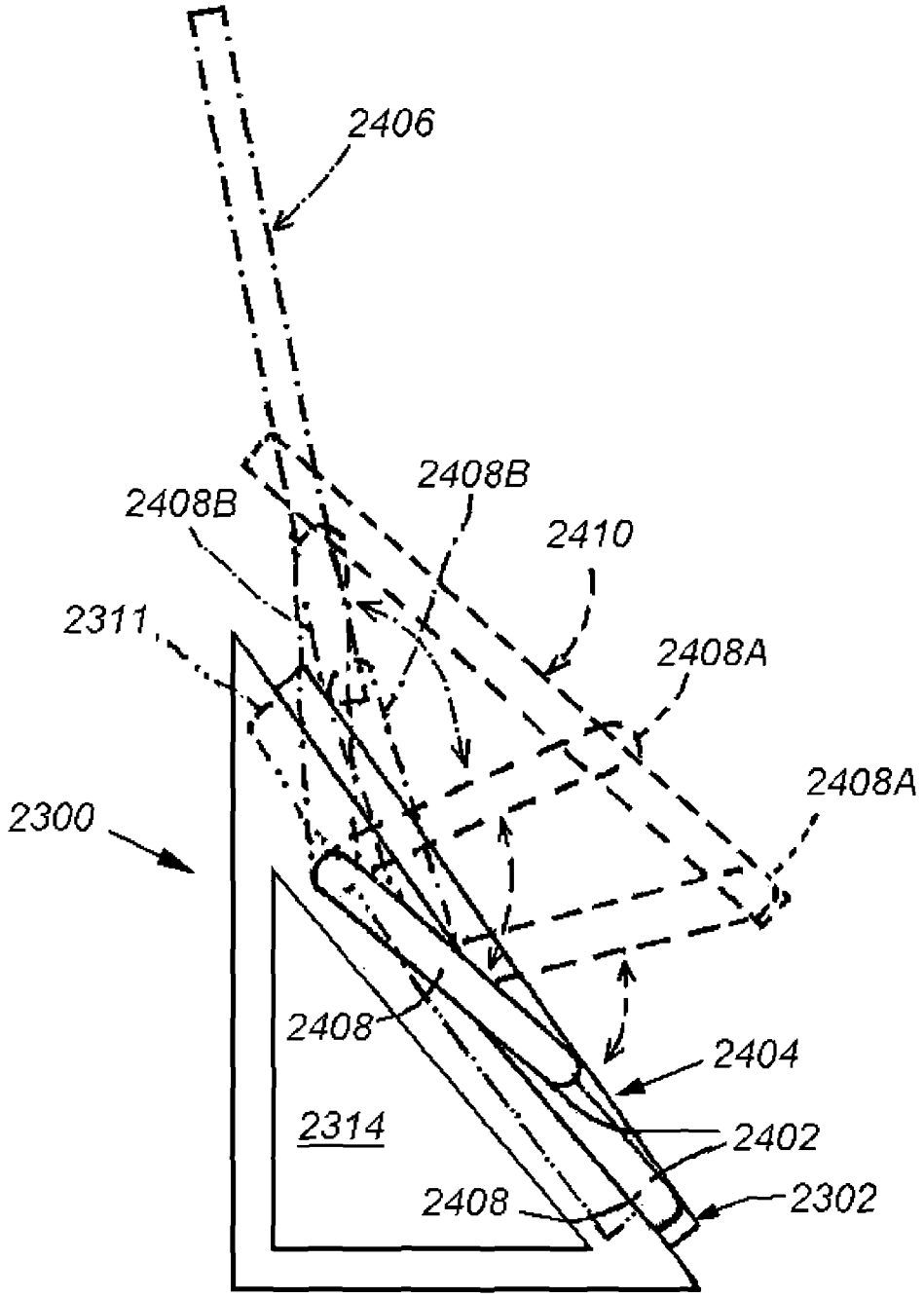
FIG. 24 is a side view of a linkage for use with the pillbox of FIG. 23 and other embodiments herein that allows a display panel to move from a closed position, covering a compartment, to an open position, allowing access to a compartment while it remains facing the user.

A linkage assembly (also briefly referred to as "linkage") 2402 for moving the display 2302 between a closed position 2404 and an open position 2406 is shown in FIG. 24. This linkage is more generally applicable to the pillbox 2300 and any other embodiments (e.g., FIG. 21 above) described above. The linkage assembly 2404 is a dual-bar assembly having pairs of bars 2408 mounted on opposing sides of the display 2302. When the user or care provider has a need to access the medication tray 2311 (shown in broken lines) within the pillbox 2300, the display 2302 is raised from the closed position 2404 through an intermediate position 2410 to the open position 2406 by operation of the linkage 2402. To accomplish this movement, the bars 2408 pivotally rotate to position 2408A and then to position 2408B. Advantageously, the illustrative linkage of FIG. 24 allows the display to remain facing the user at all times whether fully open, partially open or closed, the screen facing user does not occupy extra counter space and leaves space for the drawer. This linkage can include various locks and/or friction devices according to the art that allow it to remain in place when moved to an open position. Alternatively the linkage can be motorized to move between an open and closed position according to skill in the art. Actuation of the motor(s) can be accomplished by a user command (via a button on the pillbox or touch screen button), a remote operator or can occur automatically when a scheduled access time has occurred and/or when the server directs opening of the device—for example when an interested party instructs the device to open remotely.

In an embodiment, the display can include a static or moving image that essentially "points" to the drawer or another movable component of the device (or other embodiments herein). This image can also include various instructions that guide the user through various steps of the drawer opening process, or other processes related to operation of the pillbox.

The depicted graphical user interface (GUI) can be taken by way of an example of a wide variety of various possible implementations. In various embodiments, the screen layout and selection criteria can vary widely in accordance with ordinary skill. The screens can be adjusted in their complexity, text and/or ease of use according to the abilities and mental acuity of the user. Likewise, the various buttons and/or other selection icons can access other interface screens, allowing for the performance of various selected tasks.

The medication dispenser system as described above can be interactive, feature pre-recorded messages and have an interactive touch screen. In a further alternate embodiment, a media camera can be mounted so as to record the administration of medication. In this embodiment, the camera is activated at the time of the alert reminder to take the medication to record the administration of the medication that produces a clip that can be accessed and viewed later to confirm compliance with the therapy regime and potential complications. This also provides remote monitoring by a healthcare professional if desired. The visual display can be fitted with a built-in media camera for two-way communication using a web-based communication system, such as a voice-over-Internet Protocol system (for example, SKYPE® or an equivalent service). This allows interaction between the user and a remote healthcare professional for feedback, therapy questions or messaging. This two-way communication can also be integrated to work with an on-board medic alert system, as described above. The two-way communication system can be arranged so that the communication does not require routing through the server and can be arranged to provide direct links. A telephone number or other address/identifier can be entered/dialed directly through the medication dispenser (for example, using a touch screen interface on the media display), and the built-in microphone and speakers provide the mechanisms for the audible two-way communication. In this manner a user is provided with the ability to directly speak with and hear from a service provider or other interested party. Remotely located care givers and interested parties can observe the user to determine personal functionality, overall wellness and observe for possible side effects or interactions of the medication regime.

It is also expressly contemplated that any of the above-described embodiments can include a body having indicia for each of the compartments that are specifically adapted to the user's medication schedule. Thus, while a 4-times daily, 1-week schedule is provided by way of example, the schedule for accessing medication cups is highly variable in other exemplary implementations. For example, in another implementation, the compartments/cups can be arranged to provide four, once-daily dosages or two-twice daily dosages (i.e. each row representing one weekly dose). Other arrangements are expressly contemplated (e.g. once every other day, etc.). The caregiver/interested party can program the schedule to indicate a scheduled medication administration time. The device can be customized by the supplier/manufacturer or by the end user to provide appropriate indicia for the given medication schedule. For example each column can include an indicia for SUN through SAT and the rows can indicate each of four weeks (i.e. WEEK1-WEEK4). In an embodiment, the supplier can provide a self-adhesive overlay with the appropriate indicia. This overlay can be applied to the top of the pillbox. Alternatively, the pillbox can be free of indicia, relying upon the various electronic indicators and messages to direct the user to the proper compartment/cup.

The foregoing has been a detailed description of illustrative embodiments of the invention. Various modifications and additions can be made without departing from the spirit and scope of this invention. Each of the various embodiments described above can be combined with other described embodiments in order to provide multiple features. Furthermore, while the foregoing describes a number of separate embodiments of the apparatus and method of the present invention, what has been described herein is merely illustrative of the application of the principles of the present invention. For example, while the illustrative embodiments employ removable cups, the medication can alternately be stored directly in the compartments and the lifting of the lid or other access to the compartment (or removal of medication) can be the trigger for a sensor associated with the compartment. Likewise, while hinged lids are employed in this embodiment, in alternate embodiments the lid can allow access to a compartment, and/or cup therein, using a mechanism other than a hinge. For example, the lid can swivel away from the compartment or be completely removable. Moreover various linear drives in addition to screw drives can be used in embodiments employing such a drive system—for example, linear motors, timing belts located between opposing pulleys rack and pinion systems, and the like. Accordingly, this description is meant to be taken only by way of example, and not to otherwise limit the scope of this invention.

What is claimed is:

1. A medication dispenser comprising:

a plurality of compartments in an array within a housing, the compartments having respective lids, each of the lids being movable from a closed position to an open position, the respective lids each being secured in a locked configuration in the closed position;

an actuator mechanism, comprising a plurality of bars arranged in each of at least a first direction and a second direction, crossing the first direction, operatively connected to a processor and that controls access to each of the compartments based on a pre-programmed schedule, the actuator mechanism constructed and arranged to selectively unlock each of the lids at a predetermined time so as to place the unlocked lid in an unlocked configuration that enables the lid to be moved to the open position; and a first cam assembly and a second cam assembly, each comprising a rotating camshaft having a plurality of eccentric lobes adjacent to ends of each of the bars arranged in the first direction and the bars arranged in the second direction, respectively, an apex of each of the lobes being located at a discrete rotational orientation about a circumference of the shaft that discretely engages one of the bars arranged in the first direction and one of the bars arranged in the second direction, respectively.

2. The medication dispenser as set forth in claim 1 wherein each of the lids respectively includes a latch that is movable to selectively lock and unlock each of the lids, and the actuator mechanism includes a motor that drives a belt or chain and an actuator element attached thereto that moves selectively between each latch on at least some of the lids so that each latch is moved discretely from the locked position to the unlocked position.

3. The medication dispenser as set forth in claim 1 wherein the bars are constructed and arranged so that, when a selected one of the bars arranged in the first direction and a selected one of the bars arranged in the second direction are each moved to an unlocking position, so as to unlock one of the lids associated with the selected one of the bars arranged in the first direction and the selected one of the bars arranged in the second direction.

4. The medication dispenser as set forth in claim 3 wherein each of the bars arranged in the first direction are moved by the first cam assembly that selectively cams each of the bars on engagement therewith and each of the bars arranged in the second direction are moved by the second cam assembly that selectively cams each of the bars on engagement therewith.

5. The medication dispenser as set forth in claim 4 wherein each of the bars arranged in the first direction is spring loaded so as to be biased normally in a locking position when disengaged from the first cam assembly and each of the bars arranged in the second direction is spring loaded so as to be biased normally in a locking position when disengaged from the second cam assembly so as to lock each respective one of the lids associated with a crossing pair of the bars arranged in the first direction and the bars arranged in the second direction.

6. The medication dispenser as set forth in claim 5 wherein the first cam assembly comprises a single first cam structure on a first linear drive that moves approximately along the second direction and the second cam assembly comprises a single second cam structure on a second linear drive that moves approximately along the first direction.

7. The medication dispenser as set forth in claim 4 wherein the plurality of compartments are arranged in a plurality of approximately rectilinear rows and columns.

8. The medication dispenser as set forth in claim 1 wherein the actuator mechanism is constructed and arranged to return each of the lids in the locked configuration, when in the closed position, after placing each of the lids in the unlocked configuration.

9. The medication dispenser as set forth in claim 1 wherein the compartments each receive a removable cup therein that is accessible when a respective of the lids associated therewith is in the open position.

10. The medication dispenser as set forth in claim 9 wherein the compartments each include an illumination source that selectively operates when the respective of the lids associated therewith is in an unlocked configuration.

11. The medication dispenser as set forth in claim 10 wherein the compartments each include a sensor that respectively senses access to a respective one of the compartments.

12. The medication dispenser as set forth in claim 11 further comprising a communication system operatively connected to the processor that communicates with a remote monitoring system to provide information based upon a status of the dispenser.

13. The medication dispenser as set forth in claim 12 wherein the monitoring system is constructed and arranged to transmit control information to the dispenser that includes predetermined times at which each of the plurality of compartments is accessible.

14. The system as set forth in claim 13, further comprising a multisensory illuminated reminder system comprising a plurality of lights, each of the lights being located with respect to each cup, respectively and an audible pre-recorded alert message, followed after access of each of each of the compartments by a follow-up message.

15. The system as set forth in claim 12 wherein the communication system further comprises a wireless link that allows the user to communicate with at least one of the device and the monitoring system by a remote device associated with the user.

16. The system as set forth in claim 12 wherein the housing includes a built-in microphone assembly and a speaker assembly constructed and arranged to enable two-way communication between a user and at least one of an interested party and a service provider by at least one of (a) the communication system and (b) a third party communication network.

17. The system as set forth in claim 12 further comprising a server that communicates with an interested party and that is interconnected to the processor via the communication system, the server being constructed and arranged to control a pre-programmed schedule for access to each of the cups based upon instructions provided by the interested party and enable monitoring by the interested party of access of cups and a status of the system.

18. The system as set forth in claim 17 wherein the server is constructed and arranged to route signals to and from a service provider.

19. The system as set forth in claim 12, further comprising a display device mounted on the housing for display of at least one of static and moving images.

20. The system as set forth in claim 19 wherein the display is movably mounted on the housing so as to move between a displaying position and a cup-accessing position.

21. The system as set forth in claim 19 wherein the display is constructed and arranged to play at least one of a recorded (a) at least one of an audio, visual and media reminder message, and (b) at least one of an audio, visual and media follow-up message based upon accessing of a predetermined cup in accordance with the pre-programmed schedule.

22. The system as set forth in claim 21 wherein at least one of the reminder message and the follow-up message is recorded through a server by a client device and is stored on a memory operatively connected to the processor.

23. The system as set forth in claim 12 further comprising a camera on the housing for at least one of (a) acquisition of visual images and (b) visual communication by a user with a remote party through a network.

24. The system as set forth in claim 12 further comprising, operatively connected to the housing, a messaging system that provides at least one of audible, pictorial, textual and media messages to the user over at least one of the communication network and a third party network, and wherein the communication system constructed and arranged to deliver messages from the user over at least one of the communication network and the third party network.

* * * * *